US012523212B2

(12) United States Patent
Liu et al.

(10) Patent No.: US 12,523,212 B2
(45) Date of Patent: Jan. 13, 2026

(54) SUPPORT MECHANISM, VALVE CORE ASSEMBLY, BOOSTER PUMP, AND WATER PURIFIER

(71) Applicant: FOSHAN SHUNDE MIDEA WASHING APPLIANCES MANUFACTURING CO., LTD., Foshan (CN)

(72) Inventors: Jianbin Liu, Foshan (CN); Yaodong Wang, Foshan (CN); Hongxu Wang, Foshan (CN); Weipeng Tang, Foshan (CN); Jun Zhou, Foshan (CN); Wei Li, Foshan (CN); Maowei Chen, Foshan (CN); Zhiwen Wu, Foshan (CN)

(73) Assignee: FOSHAN SHUNDE MIDEA WASHING APPLIANCES MANUFACTURING CO., LTD., Foshan (CN)

( * ) Notice: Subject to any disclaimer, the term of this patent is extended or adjusted under 35 U.S.C. 154(b) by 66 days.

(21) Appl. No.: 18/563,229

(22) PCT Filed: Oct. 31, 2022

(86) PCT No.: PCT/CN2022/128494
§ 371 (c)(1),
(2) Date: Nov. 21, 2023

(87) PCT Pub. No.: WO2023/078192
PCT Pub. Date: May 11, 2023

(65) Prior Publication Data

US 2024/0271608 A1 Aug. 15, 2024

(30) Foreign Application Priority Data

Nov. 8, 2021 (CN) ..... 202122718278.0
Nov. 8, 2021 (CN) ..... 202122718282.7
(Continued)

(51) Int. Cl.
*F04B 43/02* (2006.01)
*F04B 43/00* (2006.01)
(Continued)

(52) U.S. Cl.
CPC ..... *F04B 43/02* (2013.01); *F04B 43/0054* (2013.01); *F04B 43/026* (2013.01);
(Continued)

(58) Field of Classification Search
CPC ..... F04B 43/02; F04B 53/16; F04B 43/0054; F04B 43/026; F04B 53/08; F04B 43/04; F04B 53/0045
See application file for complete search history.

(56) References Cited

U.S. PATENT DOCUMENTS 4,610,605 A 9/1986 Hartley
4,636,149 A 1/1987 Brown
(Continued)

FOREIGN PATENT DOCUMENTS

CN 2883721 Y 3/2007
CN 203925954 U 11/2014
(Continued)

OTHER PUBLICATIONS

The World Intellectual Property Organization (WIPO) International Search Report for PCT/CN2022/128494 Jan. 18, 2023 10 pages (including English translation).
(Continued)

*Primary Examiner* — Marina A Tietjen
(74) *Attorney, Agent, or Firm* — Anova Law Group, PLLC

(57) ABSTRACT

A support mechanism includes a base including a guide groove, and a heat-blocking member provided at the base and partially embedded in the guide groove. The heat-blocking member is configured to support a diaphragm and
(Continued)

drive the diaphragm to move. A cross-sectional area of the guide groove gradually decreases along a depth direction of the guide groove.

16 Claims, 11 Drawing Sheets

(30) Foreign Application Priority Data

| | | |
|---|---|---|
| Dec. 29, 2021 | (CN) ..... | 202111635120.5 |
| Dec. 29, 2021 | (CN) ..... | 202111635143.6 |
| Dec. 29, 2021 | (CN) ..... | 202123357215.3 |
| Dec. 29, 2021 | (CN) ..... | 202123358407.6 |

(51) Int. Cl.

| | |
|---|---|
| ***F04B 43/04*** | (2006.01) |
| ***F04B 53/08*** | (2006.01) |
| ***F04B 53/16*** | (2006.01) |

(52) U.S. Cl.

CPC ..... *F04B 43/04* (2013.01); *F04B 53/08* (2013.01); *F04B 53/16* (2013.01)

(56) References Cited

U.S. PATENT DOCUMENTS

| | | | | |
|---|---|---|---|---|
| 6,892,624 | B2 | 5/2005 | Schoenmeyr et al. | |
| 10,260,494 | B2 * | 4/2019 | Cai ..... | F04B 43/14 |
| 2003/0209138 | A1 | 11/2003 | Schoenmeyr et al. | |
| 2015/0337816 | A1 | 11/2015 | Cai et al. | |

FOREIGN PATENT DOCUMENTS

| | | | | |
|---|---|---|---|---|
| CN | 206071859 | U | | 4/2017 |
| CN | 206206130 | U | | 5/2017 |
| CN | 206889227 | U | | 1/2018 |
| CN | 209410034 | U | | 9/2019 |
| CN | 112648177 | A | | 4/2021 |
| CN | 216198922 | U | | 4/2022 |
| CN | 216198923 | U | | 4/2022 |
| CN | 216477768 | U | | 5/2022 |
| CN | 216477771 | U | | 5/2022 |
| DE | 102014000627 | B2 | | 5/2015 |
| EP | 1571338 | A1 | | 9/2005 |
| GB | 1395403 | A | | 5/1975 |
| JP | 2006169988 | A | | 6/2006 |
| KR | 20200088717 | A | | 7/2020 |
| TW | I612219 | B | * | 1/2010 |
| WO | 2015062764 | A1 | | 5/2015 |

OTHER PUBLICATIONS

The European Patent Office (EPO) Extended Search Report for EP Application No. 22889217.0 Aug. 16, 2024 6 Pages.

The China National Intellectual Property Administration (CNIPA) The First Office Action for Chinese Application 202111635120.5 Jul. 20, 2025 16 Pages (With Translation).

China National Intellectual Property Administration (CNIPA) Office Action 1 for Application No. 202111635143.6 Jun. 19, 2025 16 Pages (including translation).

The China National Intellectual Property Administration (CNIPA) The Second Office Action and Search Report for Chinese Application 202111635143.6, Sep. 17, 2025, 15 Pages (With Translation).

The China National Intellectual Property Administration (CNIPA) The Second Office Action for Chinese Application 202111635120.5, Sep. 18, 2025, 12 Pages (With Translation).

* cited by examiner

SUPPORT MECHANISM, VALVE CORE ASSEMBLY, BOOSTER PUMP, AND WATER PURIFIER

CROSS-REFERENCE TO RELATED APPLICATIONS

This application is a National Stage Entry under 35 U.S.C. § 371 of International Application No. PCT/CN2022/128494, filed on Oct. 31, 2022, and claims priority to Chinese Patent Application No. 202111635120.5 filed with China National Intellectual Property Administration on Dec. 29, 2021 and entitled "SUPPORT MECHANISM, VALVE CORE ASSEMBLY, BOOSTER PUMP, AND WATER PURIFFIER", the entire contents of which are herein incorporated by reference.

This application claims priority to Chinese Patent Application No. 202111635120.5 filed with China National Intellectual Property Administration on Dec. 29, 2021 and entitled "SUPPORT MECHANISM, VALVE CORE ASSEMBLY, BOOSTER PUMP, AND WATER PURIFIER," the entire contents of which are herein incorporated by reference.

This application claims priority to Chinese Patent Application No. 202123357215.3 filed with China National Intellectual Property Administration on Dec. 29, 2021 and entitled "SUPPORT MECHANISM, VALVE CORE ASSEMBLY, BOOSTER PUMP, AND WATER PURIFIER," the entire contents of which are herein incorporated by reference.

This application claims priority to Chinese Patent Application No. 202111635143.6 filed with China National Intellectual Property Administration on Dec. 29, 2021 and entitled "VALVE CORE ASSEMBLY, DIAPHRAGM PUMP, AND WATER PURIFIER," the entire contents of which are herein incorporated by reference.

This application claims priority to Chinese Patent Application No. 202123358407.6 filed with China National Intellectual Property Administration on Dec. 29, 2021 and entitled "VALVE CORE ASSEMBLY, DIAPHRAGM PUMP, AND WATER PURIFIER," the entire contents of which are herein incorporated by reference.

This application claims priority to Chinese Patent Application No. 202122718278.0 filed with China National Intellectual Property Administration on Nov. 8, 2021 and entitled "VALVE CORE ASSEMBLY, BOOSTER PUMP, AND WATER PURIFIER," the entire contents of which are herein incorporated by reference.

This application claims priority to Chinese Patent Application No. 202122718282.7 filed with China National Intellectual Property Administration on Nov. 8, 2021 and entitled "VALVE CORE ASSEMBLY, BOOSTER PUMP, AND WATER PURIFIER," the entire contents of which are herein incorporated by reference.

FIELD

The present disclosure relates to the field of medium pumping, and particularly relates to a support mechanism, a valve core assembly, a booster pump, and a water purifier.

BACKGROUND

With users' enhanced needs on the pumped water flow rate of liquid pumping devices, it is inevitable to improve the flow rate and the service life of the core component of pumping devices, i.e., a booster pump. According to market demands, currently the flow rate needs on the booster pump is facing a large flux development from 600 G to 800 G and 1200 G, etc.

In related technologies, with the increasing of the flow rate, the heating phenomenon of motors and bearings is more and more obvious. The internal bearing support of a diaphragm pump directly contacts a diaphragm, and this expedites the heat transfer rate from the bearing support to the diaphragm. However, high temperature will shorten the service life of the key component of the diaphragm pump, i.e., the diaphragm, and then results in the sharp increasing of the fault rate of the diaphragm pump.

Therefore, how to overcome the above defects has become a problem that needs to be solved urgently.

SUMMARY

The present disclosure aims to solve at least one of the problems that exist in the related art.

Thus, at least one embodiment of the present disclosure proposes a support mechanism.

At least one embodiment of the present disclosure proposes a valve core assembly.

At least one embodiment of the present disclosure proposes a booster pump.

At least one embodiment of the present disclosure proposes a water purifier.

At least one embodiment of the present disclosure proposes a valve core assembly.

At least one embodiment of the present disclosure proposes a booster pump.

At least one embodiment of the present disclosure proposes a water purifier.

At least one embodiment of the present disclosure proposes a valve core assembly.

At least one embodiment of the present disclosure proposes a booster pump.

At least one embodiment of the present disclosure proposes a water purifier.

At least one embodiment of the present disclosure proposes a valve core assembly.

At least one embodiment of the present disclosure proposes a booster pump.

At least one embodiment of the present disclosure proposes a water purifier.

In view of this, the first embodiment of the present disclosure proposes a support mechanism, and the support mechanism comprises: a base having a guide groove; and a heat-blocking member provided at the base, and the heat-blocking member is partially embedded in the guide groove, the heat-blocking member is configured to support a diaphragm, and the heat-blocking member is configured to drive the diaphragm to move; and a cross-sectional area of the guide groove gradually decreases along a depth direction of the guide groove.

The second embodiment of the present disclosure proposes a valve core assembly, and the valve core assembly comprises: the support mechanism in the first embodiment; and a diaphragm, provided at the heat-blocking member, and, the heat-blocking member is located between the base and the diaphragm.

The third embodiment of the present disclosure proposes a booster pump, and the booster pump comprises: a housing having a cavity; the valve core assembly in the second embodiment, provided in the cavity, and the diaphragm is connected to the housing, and the cavity is partitioned by the diaphragm.

The fourth embodiment of the present disclosure proposes a water purifier, and the water purifier comprises the booster pump in the third embodiment.

The fifth embodiment of the present disclosure proposes a valve core assembly, and the valve core assembly comprises: a base; a heat-blocking member provided at the base; a diaphragm, contacting the heat-blocking member, and, the heat-blocking member is located between the base and the diaphragm, and the heat-blocking member can drive the diaphragm to move.

The sixth embodiment of the present disclosure proposes a booster pump, and the booster pump comprises: a housing having a cavity; the valve core assembly in the fifth embodiment, provided in the cavity, and the diaphragm is connected to the housing, and the cavity is partitioned by the diaphragm.

The seventh embodiment of the present disclosure proposes a water purifier, and the water purifier comprises the booster pump in the sixth embodiment.

The eighth embodiment of the present disclosure proposes a valve core assembly, and the valve core assembly comprises: an eccentric wheel which can rotate with a first axis as the axis and has a shaft body, and a first included angle is formed between the axis of the shaft body and the first axis; a support mechanism, sleeved on the shaft body; a diaphragm, connected to the support mechanism; and the surface of the support mechanism contacting the diaphragm is a contact surface, and in the radial direction of the shaft body from outside to inside, the contact surface extends towards a direction away from the diaphragm.

The ninth embodiment of the present disclosure proposes a booster pump, and the booster pump comprises: a housing having a cavity; the valve core assembly in the eighth embodiment, provided in the cavity, and the diaphragm is connected to the housing, and the cavity is partitioned by the diaphragm.

The tenth embodiment of the present disclosure proposes a water purifier, and the water purifier comprises the booster pump in the ninth embodiment.

The eleventh embodiment of the present disclosure proposes a valve core assembly, and the valve core assembly comprises: an eccentric wheel which can rotate with a first axis as the axis and has a shaft body, and a third included angle is formed between the axis of the shaft body and the first axis; a support mechanism, sleeved on the shaft body; a diaphragm, connected to the support mechanism; and the intersection point of the first axis and the axis of the shaft body is a first intersection point; the first intersection point is located on a surface of the diaphragm or within the diaphragm.

The twelfth embodiment of the present disclosure proposes a booster pump, and the booster pump comprises: a housing having a cavity; the valve core assembly in the eleventh embodiment, provided in the cavity, and the diaphragm is connected to the housing, and the cavity is partitioned by the diaphragm.

The thirteenth embodiment of the present disclosure proposes a water purifier, and the water purifier comprises the booster pump in the twelfth embodiment.

The additional aspects and advantages of the present disclosure will be obvious in the following description, or can be understood through the implementation of the present disclosure.

BRIEF DESCRIPTION OF THE DRAWINGS

The above and/or additional aspects and advantages of the present disclosure will be obvious and understood easily from the following description of the embodiments in combination with the accompanying drawings. And, FIG. 1 is a first schematic view of the structure of a support mechanism according to an embodiment of the present disclosure.

Figure 1:
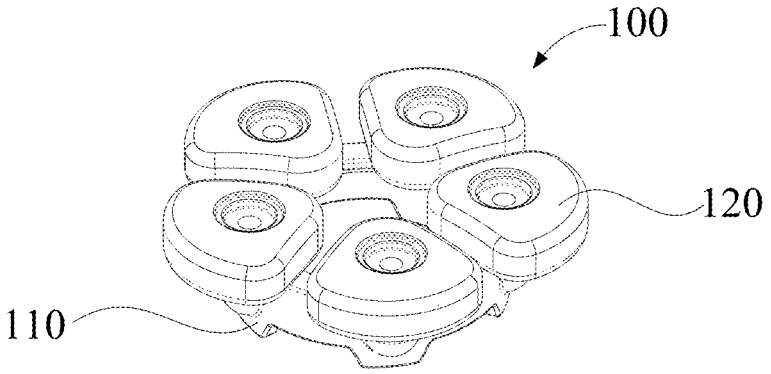

And the corresponding relationships between the reference signs and the component names in FIG. 1 to FIG. 22 are as follows:

100: support mechanism, 110: base, 112: positioning member, 1122: guide groove, 114: guide member, 116: contact surface, 118: first convex rib, 120: heat-blocking member, 121: base body, 122: mounting groove, 124: protrusion member, 126: connection member, 200: valve core assembly, 210: diaphragm, 220: compression member, 230: eccentric wheel, 232: shaft body, 234: shaft hole, 236: second convex rib, 250: drive assembly, 252: drive shaft, 254: bearing, 256: drive member, 300: booster pump, and 310: housing.

DETAILED DESCRIPTION OF THE DISCLOSURE

To more clearly understand the above purposes, features and advantages of the present disclosure, the present disclosure will be further detailed hereinafter in combination with the accompanying drawings and embodiments. It should be indicated that in the case of no conflict, the embodiments and the features in the embodiments of the present disclosure can be combined with each other.

Many details are illustrated in the following description for the convenience of a thorough understanding to the present disclosure, but the present disclosure can further be implemented using other embodiments other than these described herein. Therefore, the protection scope of the present disclosure is not limited to the embodiments disclosed in the following text.

A support mechanism, a valve core assembly, a booster pump, and a water purifier according to some embodiments of the present disclosure are described in the following by referring to FIG. 1 to FIG. 22.

As shown in FIG. 1, FIG. 2, FIG. 5 and FIG. 6, at least one embodiment of the present disclosure proposes a support mechanism 100, and the support mechanism 100 comprises: a base 110 having a guide groove 1122; and a heat-blocking member 120 provided at the base 110, and the heat-blocking member 120 is partially embedded in the guide groove 1122, the heat-blocking member 120 is configured to support a diaphragm 210, and the heat-blocking member 120 is configured to drive the diaphragm 210 to move, and a cross-sectional area of the guide groove 1122 gradually decreases in a depth direction of the guide groove 1122.

The present disclosure defines a support mechanism 100 applied to a booster pump 300; the support mechanism 100 comprises the base 110, the base 110 is configured to connect the diaphragm 210 on the booster pump 300 and drive the diaphragm 210 to move in the booster pump 300. The diaphragm 210 is a core component in the booster pump 300; the base 110 is configured to connect the diaphragm 210 and a drive assembly 250; the drive assembly 250 drives the diaphragm 210 to swing in the booster pump 300 through driving a bearing 254 on the base 110 to swing; the swinging diaphragm 210 can change the space size of a pumping cavity on the inner side of the base 110, when the swinging diaphragm 210 increases the pumping cavity, a negative pressure pressurizes a liquid into the pumping cavity. On the contrary, when the swinging diaphragm 210 shrinks the pumping cavity, the previously pumped liquid is pushed out of the pumping cavity, to meet the pumping needs of the liquid.

In related technologies, upon product demands, the requirements for the pumping flow rate of the booster pump are higher and higher, the flow rate of the booster pump in the market is facing a large flux development from 600 G to 800 G and 1200 G. One method for increasing the pumping flow rate is to expedite the motion frequency of the diaphragm 210, while the high speed efficiency way will generate a large amount of heat in the operation process, which results in the temperature rising of the base 110 and the diaphragm 210 that contacts the base 110, and the actual temperature can reach about 70° C. The diaphragm 210 is generally prepared by elastic materials such as rubber, and thus the high temperature can produce an irreversible effect on the diaphragm 210, and renders the rapid aging of the diaphragm 210. Therefore, the problems are produced that the diaphragm 210 has a short service life and a high fault rate, and the booster pump 300 has a poor reliability.

In view of this, the present disclosure provides the heat-blocking member 120 in the support mechanism 100. In an embodiment, the heat-blocking member 120 is fixed on the base 110, and the heat-blocking member 120 is configured to support the diaphragm 210; after assembled, the heat-blocking member 120 is located between the base 110 and the diaphragm 210, and the heat-blocking member 120 keeps contacting the diaphragm 210; when the heat-blocking member 120 moves with the base 110, the diaphragm 210 which keeps contacting the heat-blocking member 120 deforms. The heat-blocking member 120 has a good heat-blocking performance, and thus can slow down the heat transfer efficiency between the base 110 and the diaphragm 210. In an embodiment, the heat-blocking member 120 can be prepared by a PA6+30GF material (nylon 66+30% glass fiber), or heat-blocking materials such as ceramics, while the present embodiment does not rigidly limit the material of the heat-blocking member 120 as along as it can meet the heat-blocking requirements.

Through disposing the heat-blocking member 120 between the base 110 and the diaphragm 210, the heat transfer efficiency between the base 110 and the diaphragm 210 can be effectively reduced, and the temperature of the diaphragm 210 in the operation process is reduced, and the diaphragm 210 is prevented from being damaged due to the high temperature. Therefore, the problem in the related technologies is solved. The effects are further achieved that the structure of a valve core assembly 200 is optimized, the service life of the diaphragm 210 is prolonged on the basis of satisfying the pumping requirement for high flow rate, the fault rate of the support mechanism 100 is lowered and the fault rate of the booster pump 300 is lowered.

In the embodiment, the base 110 and the heat-blocking member 120 are separated structures, and through disposing the separated base 110 and heat-blocking member 120, firstly, metal materials with high strength can be selected for the base 110, to ensure that the base 110 can drive the diaphragm 210 to move at a high speed for a long time, and the fault rate of the base 110 is lowered; secondly, the heat-blocking performance of the heat-blocking member 120 can be adjusted through selecting or changing different materials of heat-blocking member 120, and thus, the corresponding material can be selected for the heat-blocking member 120 according to the requirement for the pumping flow rate of the booster pump 300, and therefore, the costs of the support mechanism 100 are reduced on the basis that the heat-blocking requirement is satisfied.

On the above basis, the guide groove 1122 is provided in the base 110; the shape of the guide groove 1122 matches the outer contour of a portion of the heat-blocking member 120; the positioning and assembling of the heat-blocking member 120 on the base 110 are accomplished through embedding a portion of the heat-blocking member 120 into the guide groove 1122, to ensure the accuracy of the positioning of the heat-blocking member 120 on the base 110, and ensure that the base 110 and the heat-blocking member 120 can drive the diaphragm 210 to swing accurately. And, the cross-sectional area of the guide groove 1122 can be determined through sectioning the guide groove 1122 by a plane which is perpendicular to the depth direction of the guide groove 1122; in addition, the cross-sectional area of the guide groove 1122 gradually decreases along the depth direction of the guide groove 1122, and thus this forms a guide groove 1122 tapering from top to bottom. Through limiting that the guide groove 1122 tapers along the depth direction, a guide groove 1122 presenting a bellmouth shape can be formed, and thus a guide function can be achieved through the bellmouth, and a portion of the heat-blocking member 120 can slide to a predetermined mounting position after placed in the guide groove 1122, and the probability of false assembling of the heat-blocking member 120 is lowered. The effects can be further achieved that the positioning structure of the heat-blocking member 120 is optimized, the positioning accuracy of the heat-blocking member 120 is enhanced, and the yield rate of the support mechanism 100 is enhanced.

As shown in FIG. 3, FIG. 4, FIG. 5 and FIG. 6, in at least one embodiment of the present disclosure, the base 110 further comprises a blind hole; the support mechanism 100 further comprises a guide member 114 provided in the blind hole and including a guide slope opposite to a side wall of the blind hole; the guide groove 1122 is enclosed by the guide slope and the blind hole.

In the embodiment, the structure of the base 110 is further defined. The surface of the base 110 facing the heat-blocking member 120 is disposed with the blind hole, and the guide member 114 is provided in the blind hole; the guide slopes are formed on the peripheral side of the guide member 114; and the guide groove 1122 is enclosed jointly by the guide slopes, the bottom wall of the blind hole and the side wall of the blind hole. And, the guide slopes are inclined with respect to the side wall of the blind hole, to form a tapering guide groove 1122. After the heat-blocking member 120 is assembled, a portion of the heat-blocking member 120 is embedded into the guide groove 1122 and fills the guide groove 1122, to position the heat-blocking member 120 accurately, and prevent the shaking of the heat-blocking member 120 with respect to the base 110 in the operation process. Furthermore, the control accuracy of the diaphragm 210 is improved and the fluid pumping efficiency is controlled accurately.

In any of the above embodiments, the guide member 114 is a frustum, and a bottom surface of the frustum is connected to the bottom wall of the blind hole.

In the embodiment, based on the above embodiments, the shape of the guide member 114 is further defined. The guide member 114 is a frustum, the bottom surface of the frustum is connected to the bottom wall of the blind hole, the top surface faces the heat-blocking member 120; and multiple side surfaces of the frustum are the guide slopes.

And, the shapes of the cross-sections of the guide groove 1122 and the guide member 114 are both regular polygons, in some embodiments, the shape of the cross-section of the guide groove 1122 is an equilateral triangle, the guide member 114 is a corresponding triangular frustum, and the shape of the cross-section of the guide groove 1122 is a regular quadrilateral; the guide member 114 is a corresponding quadrangular frustum, or the shape of the cross-section of the guide groove 1122 is a regular octagon, and the guide member 114 is a corresponding octagonal frustum. In the operation process, the peripheral side surface of the frustum abuts the side wall of the guide groove 1122, to prevent the heat-blocking member 120 from rotating with respect to a positioning member 112. The present embodiment does not rigidly define the shapes of the guide groove 1122 and the guide member 114 as long as they can satisfy the above positioning requirements.

In any of the above embodiments, the guide member 114 is a hexagonal frustum.

In the embodiment, the shape of the cross-section of the guide groove 1122 is a regular hexagon, and correspondingly the shape of the cross-section of the guide member 114 is a regular hexagon; and the heat-blocking member 120 can be clamped on the positioning member 112 as long as a portion of the heat-blocking member 120 is inserted between the hexagonal frustum and the guide groove 1122. And, the hexagonal frustum is provided with a through hole and a connection member 126 connects the heat-blocking member 120 with the base 110.

In an embodiment, the heat-blocking member 120 is in interference fit with the guide groove 1122, and through limiting the interference fit relationship, a tight connection between the base 110 and the heat-blocking member 120 can be achieved, and this helps improve the positioning accuracy of the heat-blocking member 120, and prevent the heat-blocking member 120 from dislocating with respect to the positioning member 112 or even escaping from the positioning member 112 in the operation process. Furthermore, the effect is achieved that the stability and reliability of the structure of the support mechanism 100 are improved.

In any of the above embodiments, N guide grooves 1122 are arranged uniformly at the base 110; and, N is an integer greater than 2.

In the embodiment, N positioning members 112 are provided at the base 110, and each positioning member 112 is provided with one guide groove 1122. On the above basis, the arranging method of the guide grooves 1122 on the base 110 is defined. The base 110 is an annular structure. On the base 110, at least three guide grooves 1122 are arranged uniformly in a same circle which takes the axis of the base 110 as the axis, to form an array of the guide grooves 1122 in an annular arrangement in the base 110. Through arranging the plurality of guide grooves 1122 uniformly along a circle in the base 110, the uniformity of the force distribution of the base 110 can be improved, and the diaphragm 210 is prevented from being damaged due to uneven stress. The effects are further achieved that the structure of the base 110 is optimized and the service life of the diaphragm 210 is prolonged.

In any of the above embodiments, the base 110 presents an annular shape, and the N guide grooves 1122 are uniformly arranged in the same circle which takes the axis of the base 110 as the axis.

In the embodiment, the arranging method of the guide grooves 1122 on the base 110 is defined. The base 110 is an annular structure. On the base 110, at least three guide grooves 1122 are arranged uniformly in the same circle which takes the axis of the base 110 as the axis, to form an array of the guide grooves 1122 in an annular arrangement in the base 110. Through arranging the plurality of guide grooves 1122 uniformly along a circle in base 110, the uniformity of the force distribution of the base 110 can be improved, and the diaphragm 210 is prevented from being damaged due to uneven stress. The effects are further achieved that the structure of the base 110 is optimized and the service life of the diaphragm 210 is prolonged.

Figure 2:
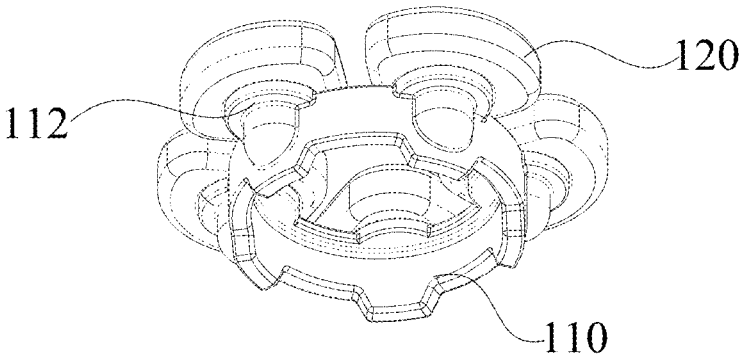
FIG. 2 is a second schematic view of the structure of a support mechanism according to an embodiment of the present disclosure.

As shown in FIG. 1 and FIG. 2, in any of the above embodiments, N heat-blocking members 120 are connected to the N guide grooves 1122 in a one-to-one correspondence manner.

In the embodiment, the number of the heat-blocking members 120 and the corresponding relationship between the heat-blocking members 120 and the guide grooves 1122 are defined. The number of the heat-blocking members 120 is equal to the number of the guide grooves 1122, and the N guide grooves 1122 and the N heat-blocking members 120 are arranged in a one-to-one correspondence manner, to form an array of the N heat-blocking members 120 in an annular arrangement on the base 110, and to jointly support the diaphragm 210 through the N heat-blocking members 120. Through disposing the N heat-blocking members 120 corresponding to the N guide grooves 1122, the contact area between the heat-blocking members 120 and the diaphragm 210 can be decreased on the basis of satisfying the requirements for positioning and connecting the diaphragm 210, to avoid affecting the movement range of the diaphragm 210 due to a large area contact. Moreover, the effects are further achieved that the structure of the support mechanism 100 is optimized and the pumping performance of the support mechanism 100 is enhanced.

As shown in FIG. 7, FIG. 8, FIG. 9 and FIG. 10, in at least one embodiment of the present disclosure, the heat-blocking member 120 comprises: a base body 121; and a protrusion member 124 provided at the base body 121, and the protrusion member 124 is embedded in the guide groove 1122.

In the embodiment, the structure of the heat-blocking member 120 is defined. The heat-blocking member 120 comprises the base body 121 and the protrusion member 124, the base body 121 is located at the outer side of the guide groove 1122 and configured to support and connect the diaphragm 210; the top surface of the base body 121 keeps contacting the diaphragm 210; when the base 110 is driven to swing, the base body 121 pushes and pulls the diaphragm 210 and the diaphragm 210 deforms, and the size of the cavity at one side away from the base 110 is changed through the deformed diaphragm 210, to accomplish the drawing and pumping of liquids. The protrusion member 124 is provided at the bottom surface of the base body 121; the shape of the protrusion member 124 matches the shape of the guide groove 1122, and in an assembling process, the protrusion member 124 is firstly aligned with the guide groove 1122, and then is accurately pushed to the inside of the guide groove 1122 through the guide slopes, to accurately position the heat-blocking member 120 on the base 110.

And, the positioning member 112 presents a cylindrical structure; the heat-blocking member 120 is provided with a mounting groove 122 which has a shape matching the outer contour of the positioning member 112. In an assembling process, the positioning member 112 is firstly aligned with the mounting groove 122, and then is inserted in the mounting groove 122, and thus the assembling of the heat-blocking member 112 is accomplished. Through disposing the mounting groove 122, it can cooperate with the positioning member 112 and the guide groove 1122 to form an embedded type positioning and connecting structure, to improve the positioning accuracy of the heat-blocking member 120. Meanwhile, the embedded type connecting structure can improve the positioning stability of the heat-blocking member 120, and prevent the heat-blocking member 120 from dislocating or even dropping in a long-time reciprocating movement. Moreover, the effects are further achieved that the structure stability of the support mechanism 100 is improved and the fault rate of the support mechanism 100 is reduced.

In any of the above embodiments, the protrusion member 124 is in interference fit with the guide groove 1122.

In the embodiment, based on the above embodiment, the protrusion member 124 is in interference fit with the guide groove 1122. The side of the protrusion member 124 facing the base 110 is the front end of the protrusion member 124, while the opposite side is the rear end of the protrusion member 124. In an assembling process, after the protrusion member 124 is aligned with the guide groove 1122, the front end of the protrusion member 124 is placed on the guide slopes, and under the effect of the guide slopes, the protrusion member 124 slides towards the bottom of the guide groove 1122, and the preassembling of the heat-blocking member 120 is accomplished. However, since the size of the protrusion member 124 at the moment is greater than the size of the guide groove 1122, the protrusion member 124 is not completely sunk into the guide groove 1122, and then is pressed in the guide groove 1122 through the connection member 126, and the external surface of the protrusion member 124 is attached tightly to the inner wall surface of the guide groove 1122, to remove the gap between the protrusion member 124 and the guide groove 1122 and preventing the heat-blocking member 120 from dislocating or even dropping in the operation process. Moreover, the effects are further achieved that the positioning structure of the heat-blocking member 120 is optimized, the positioning accuracy of the heat-blocking member 120 is improved and the fault rate of the support mechanism 100 is reduced.

Figure 11:
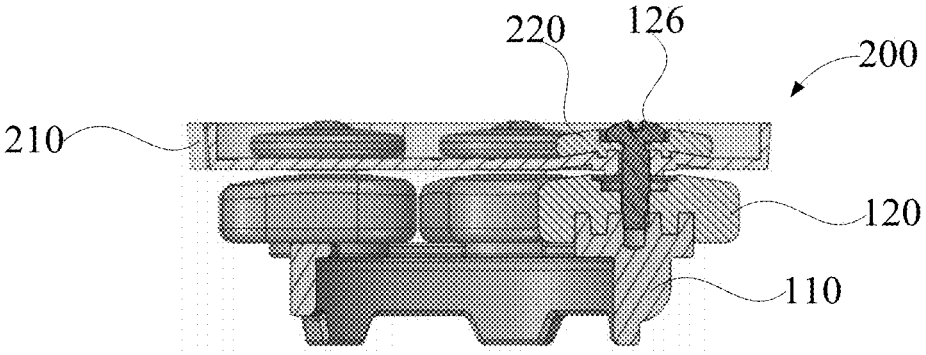
FIG. 11 is a first schematic view of the structure of a valve core assembly according to an embodiment of the present disclosure.

As shown in FIG. 1, FIG. 2 and FIG. 11, in at least one embodiment of the present disclosure, the heat-blocking member 120 is detachably connected to the base 110.

In the embodiment, the heat-blocking member 120 is detachably connected to the base 110. Through disposing the detachable structure, firstly, a modularization design for the base 110 and the heat-blocking member 120 can be achieved, and the heat-blocking member 120 with the corresponding heat-blocking performance is disposed for the base 110 with different pumping efficiencies; secondly, through disposing the detachable heat-blocking member 120, the maintenance for the support mechanism 100 can be finished rapidly by removing and replacing the heat-blocking member 120 when it is aging or damaged, and this brings convenience for users and reduces the difficulty and costs for product maintenance.

In any of the above embodiments, the support mechanism 100 further comprises a connection member 126 configured to connect the base 110 and the heat-blocking member 120.

In the embodiment, the valve core assembly 200 is further provided with the connection member 126; after the initial positioning of the heat-blocking member 120 is accomplished through the guide groove 1122, the heat-blocking member 120 is connected to the base 110 through the connection member 126, and the base 110 can drive both the heat-blocking member 120 and the diaphragm 210 to swing to prevent the separation of the heat-blocking member 120 from the base 110.

In an embodiment, the connection member 126 can be a screw; when the screw is selected as the connection member 126, a first screw hole is disposed in the heat-blocking member 120, the protrusion member 124 is disposed surrounding the first screw hole; the base 110 is correspondingly disposed with a second screw hole, and the second screw hole is disposed in the guide member 114; the screw passes through the first screw hole and sinks into the second screw hole to connect the heat-blocking member 120 and the base 110. Thus, the structure is only one selectable structure of the connection member 126, and the connection between the heat-blocking member 120 and the base 110 can be accomplished through disposing other connecting structures such as buckles and slots; the present disclosure does not make any rigid limitation to the structure of the connection member 126 as long as it can satisfy the requirements for reliable connection.

As shown in FIG. 11, at least one embodiment of the present disclosure provides a valve core assembly 200, and the valve core assembly 200 comprises: the support mechanism 100 in any of the above embodiments; and a diaphragm 210, provided at the heat-blocking member 120, and, the heat-blocking member 120 is located between the base 110 and the diaphragm 210.

In the embodiment, the valve core assembly 200 disposed with the support mechanism 100 in any of the above embodiments is defined, and thus, the valve core assembly 200 has the advantages of the support mechanism 100 in any of the above embodiments, and can achieve the effect that the support mechanism 100 in any of the above embodiments achieves.

In related technologies, upon product demands, the requirements for the pumping flow rate of the booster pump are higher and higher, the flow rate of the booster pump in the market is facing a large flux development from 600 G to 800 G and 1200 G. One method for increasing the pumping flow rate is to expedite the motion frequency of the diaphragm 210, while the high speed efficiency way will generate a large amount of heat in the operation process, which results in the temperature rising of the base 110 and the diaphragm 210 that contacts the base 110, and the actual temperature can reach about 70° C. The diaphragm 210 is generally prepared by elastic materials such as rubber, and thus the high temperature can produce an irreversible effect on the diaphragm 210, and renders the rapid aging of the diaphragm 210. Therefore, the problems are produced that the diaphragm 210 has a short service life and a high fault rate, and the booster pump 300 has a poor reliability.

In view of this, the present disclosure provides the heat-blocking member 120 in the support mechanism 100. In an embodiment, the heat-blocking member 120 is fixed on the base 110, the heat-blocking member 120 is configured to support the diaphragm 210; after assembled, the heat-blocking member 120 is located between the base 110 and the diaphragm 210, and the heat-blocking member 120 keeps contacting the diaphragm 210; when the heat-blocking member 120 moves with the base 110, the diaphragm 210 which keeps contacting the heat-blocking member 120 deforms. The heat-blocking member 120 has a good heat-blocking performance, and thus can slow down the heat transfer efficiency between the base 110 and the diaphragm 210. The heat-blocking member 120 can be prepared by a PA6+30GF material (nylon 66+30% glass fiber), or heat-blocking materials such as ceramics, while the present embodiment does not rigidly limit the material of the heat-blocking member 120 as along as it can meet the heat-blocking requirements.

Through disposing the heat-blocking member 120 between the base 110 and the diaphragm 210, the heat transfer efficiency between the base 110 and the diaphragm 210 can be effectively reduced, and the temperature of the diaphragm 210 in the operation process is reduced, and the diaphragm 210 is prevented from being damaged due to the high temperature. Therefore, the problem in the related technologies is solved. The effects are further achieved that the structure of a valve core assembly 200 is optimized, the service life of the diaphragm 210 is prolonged on the basis of satisfying the pumping requirement for high flow rate, the fault rate of the valve core assembly 200 is lowered and the fault rate of the booster pump 300 is lowered.

In the embodiment, the base 110 and the heat-blocking member 120 are separated structures, and through disposing the separated base 110 and heat-blocking member 120, firstly, metal materials with high strength can be selected for the base 110, to ensure that the base 110 can drive the diaphragm 210 to move at a high speed for a long time, and the fault rate of the base 110 is lowered; secondly, the heat-blocking performance of the heat-blocking member 120 can be adjusted through selecting or changing different materials of heat-blocking member 120, and thus, the corresponding material can be selected for the heat-blocking member 120 according to the requirement for the pumping flow rate of the booster pump 300, and therefore, the costs of the valve core assembly 200 are reduced on the basis that the heat-blocking requirement is satisfied.

In any of the above embodiments, the valve core assembly 200 further comprises a compression member 220, provided at the diaphragm 210 and being away from the heat-blocking member 120, and the compression member 220 is connected to the heat-blocking member 120 and is configured to compress the diaphragm 210 on the heat-blocking member 120.

In the embodiment, the valve core assembly 200 is further provided with the compression member 220; the compression member 220 is disposed on the diaphragm 210, and the connection member 126 passes through the diaphragm 210 and connects the compression member 220 with the heat-blocking member 120, to compress the diaphragm 210 on the heat-blocking member 120 through the compression member 220, and the diaphragm 210 is tightly attached to the top surface of the heat-blocking member 120, and thus the assembling and clamping of the diaphragm 210 are achieved. And, the diaphragm 210 is a main operation portion in a booster pump 300, and in the operation process, the booster pump 300 drives the diaphragm 210 to move to change the size of the space partitioned by the diaphragm 210, and accomplishes the drawing, pressure boosting and discharging of mediums. Through disposing the connection member 126 and the compression member 220, the diaphragm 210 can be accurately positioned in the booster pump 300, to lower the possibility of dislocating of the diaphragm 210 in the operation process. In addition, the diaphragm 210 can be tightly attached to the base 110 by the compression member 220, and thus this removes the gap between a first positioning surface and the diaphragm 210, and thus improves the movement accuracy of the diaphragm 210 and ensures the pumping efficiency of the valve core assembly 200.

Figure 12:
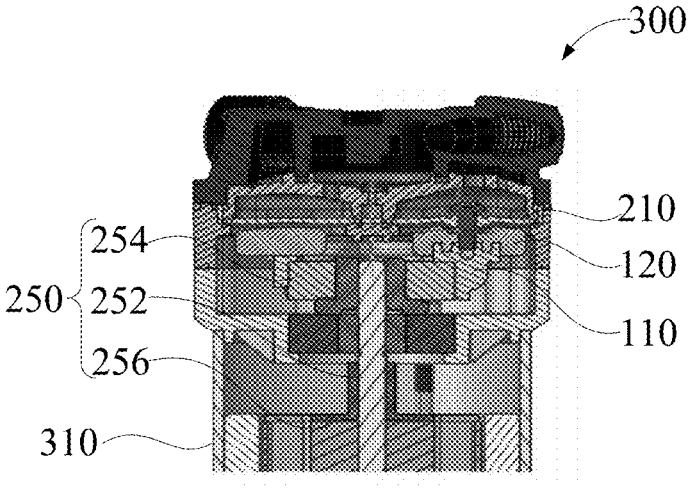
FIG. 12 is a first schematic view of the structure of a booster pump according to an embodiment of the present disclosure.

As shown in FIG. 12, at least one embodiment of the present disclosure provides a booster pump 300, and the booster pump 300 comprises: a housing 310 having a cavity; the valve core assembly 200 in any of the above embodiments, provided in the cavity, and the diaphragm 210 is connected to the housing 310, and the cavity is partitioned by the diaphragm 210.

In the embodiment, the booster pump 300 provided with the valve core assembly 200 in any of the above embodiments is defined, and thus the booster pump 300 has the advantages of the valve core assembly 200 in any of the above embodiments, and can achieve the effect that the valve core assembly 200 in any of the above embodiments achieves, which are not described herein for avoiding repetition.

In an embodiment, the booster pump 300 comprises the housing 310, and the housing 310 is an external frame structure of the booster pump 300, and configured to enclose and define the cavity. The base 110 and the compression member 220 are disposed in the cavity, and position the diaphragm 210 in the housing 310. And the peripheral side of the diaphragm 210 is connected to the inner wall of the housing 310, to partition the cavity into two sub-cavities; the base 110 and the compression member 220 are respectively located in the sub-cavities at the two sides of the diaphragm 210. When the base 110 drives a portion of the diaphragm 210 and the compression member 220 to move with respect to the housing 310, the diaphragm 210 connected to the housing 310 is pushed and pulled, and thus deformed. In a pulling process, the volume of the sub-cavity where the compression member 220 is located increases, and the booster pump 300 can absorb mediums into the sub-cavity. When the diaphragm 210 is pushed by the base 110 towards the direction of the compression member 220, the volume of the sub-cavity where the compression member 220 is located decreases, and the mediums in the sub-cavity is pushed out of the booster pump 300. Furthermore, the booster pump 300 achieves medium pumping.

In any of the above embodiments, the housing 310 further comprises an inlet and an outlet, and the inlet and the outlet communicate with the cavity at the side of the diaphragm 210 away from the base 110; the booster pump 300 further comprises: a drive assembly 250, connected to the base 110 and configured to drive the base 110 to swing with respect to the housing 310.

In the embodiment, the housing 310 is provided with the inlet and the outlet for the entering and exiting of the mediums. Both the inlet and the outlet communicate with the sub-cavity at one side of the diaphragm 210. The base 110 and a drive member 256 are provided in the sub-cavity at the side away from the inlet and the outlet. The drive assembly 250 is fixed on the housing 310, and the base 110 connects the drive assembly 250 and the diaphragm 210. When the booster pump 300 operates, the drive assembly 250 drives the base 110 and the compression member 220 to move with respect to the housing 310, to achieve the absorbing and discharging of the mediums through pushing and pulling the diaphragm 210.

In any of the above embodiments, the drive assembly 250 comprises: a drive member 256 having a drive shaft 252; an eccentric wheel 230, sleeved on the drive shaft 252; a bearing 254, and an inner ring of the bearing 254 is sleeved on the eccentric wheel 230, and an outer ring of the bearing 254 passes through the base 110.

In the embodiment, the structure of the drive assembly 250 is defined. The drive assembly 250 comprises the drive member 256, the eccentric wheel 230 and the bearing 254. The eccentric wheel 230 and the bearing 254 are transmission structures between the base 110 and the drive member 256; the bearing 254 is sleeved on the shaft body 232 of the eccentric wheel 230, and the base 110 is sleeved on the outer side of the bearing 254. In the operation process, the eccentric wheel 230 rotates about a first axis, while a first included angle is formed between the axis of the shaft body 232 and the first axis, and the base 110 which is sleeved on the shaft body 232 can rotate eccentrically around the first axis at the same time. The diaphragm 210 is provided at the base 110 and connected to the base 110. The diaphragm 210 is made of elastic materials and thus can deform when it is pushed and pulled, and thus the volume of the cavity in the booster pump 300 is changed, in some embodiments, when the diaphragm 210 is pulled outwards, the volume of the cavity increases, and on the contrary, when the diaphragm 210 restores its original state or is pushed inwards, the volume of the cavity decreases, and thus, the drawing and pumping of the liquids are achieved through the pushing and pulling.

The fourth aspect of the present disclosure proposes a water purifier, and the water purifier comprises the booster pump 300 in any of the above embodiments.

In the embodiment, the water purifier provided with the booster pump 300 in any of the above embodiments is defined, and thus the water purifier has the advantages of the booster pump 300 in any of the above embodiments, and can achieve the effect that the booster pump 300 in any of the above embodiments achieves, which are not described herein for avoiding repetition.

Figure 3:
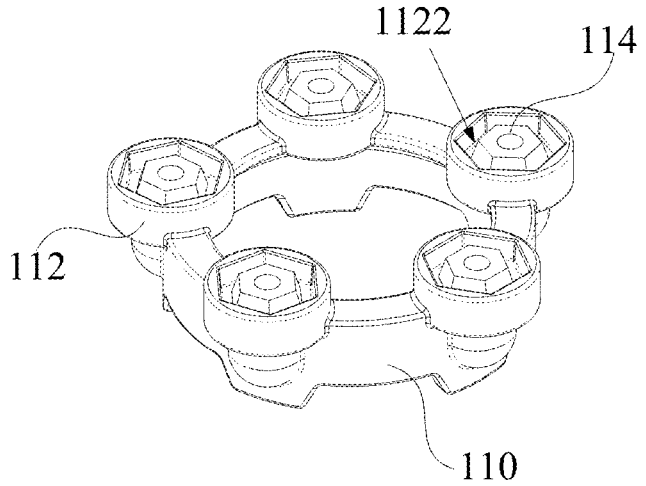
FIG. 3 is a first schematic view of the structure of a base according to an embodiment of the present disclosure.
Figure 4:
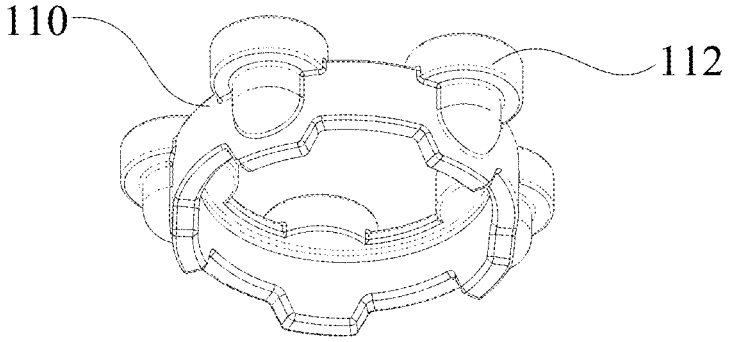
FIG. 4 is a second schematic view of the structure of a base according to an embodiment of the present disclosure.
Figure 5:
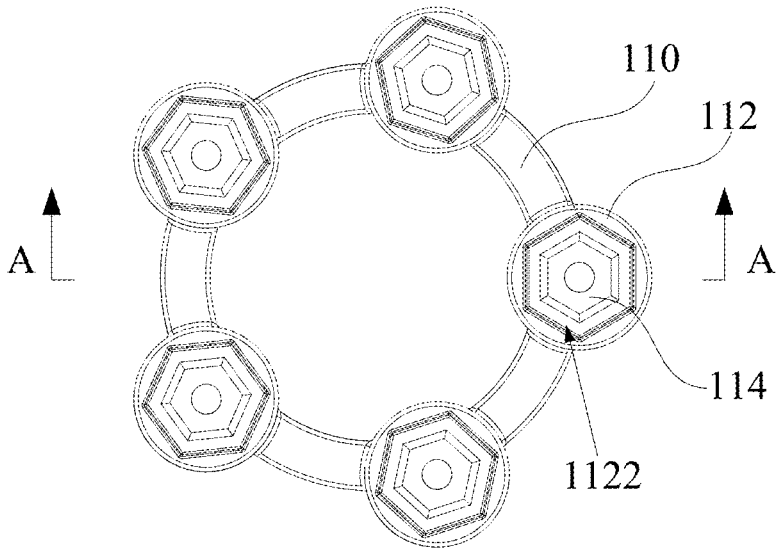
FIG. 5 is a third schematic view of the structure of a base according to an embodiment of the present disclosure.
Figure 6:
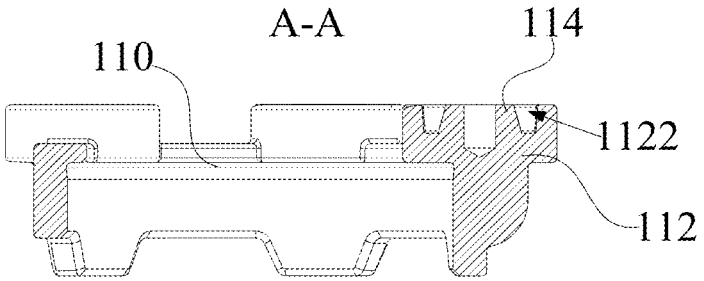
FIG. 6 is a sectional view of the base in the direction A-A in the embodiment as shown in FIG. 5.
Figure 7:
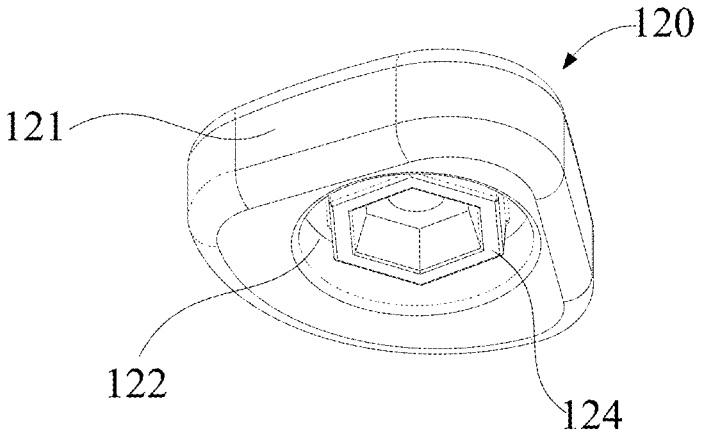
FIG. 7 is a first schematic view of the structure of a heat-blocking member according to an embodiment of the present disclosure.

As shown in FIG. 11, FIG. 3 and FIG. 7, at least one embodiment of the present disclosure provides a valve core assembly 200, and the valve core assembly 200 comprises: a base 110; a heat-blocking member 120 provided at the base 110; a diaphragm 210, contacting the heat-blocking member 120, and the heat-blocking member 120 is located between the base 110 and the diaphragm 210, and the heat-blocking member 120 can drive the diaphragm 210 to move.

The present disclosure defines the valve core assembly 200 applied to the booster pump 300, and the valve core assembly 200 comprises the base 110 and the diaphragm 210. The diaphragm 210 is a core component in the booster pump 300; the base 110 is configured to connect the diaphragm 210 with a drive assembly 250; the drive assembly 250 drives the diaphragm 210 to move in the booster pump 300 through driving the bearing 254 on the base 110; the moving diaphragm 210 can change the space size of a pumping cavity on the inner side of the base 110, when the moving diaphragm 210 increases the pumping cavity, a negative pressure pressurizes liquids into the pumping cavity. On the contrary, when the moving diaphragm 210 shrinks the pumping cavity, the previously pumped liquids are compressed out of the pumping cavity, to meet the requirement for liquid pumping.

In related technologies, upon product demands, the requirements for the pumping flow rate of the booster pump are higher and higher, the flow rate of the booster pump in the market is facing a large flux development from 600 G to 800 G and 1200 G. One method for increasing the pumping flow rate is to expedite the motion frequency of the diaphragm 210, while the high speed efficiency way will generate a large amount of heat in the operation process, which results in the temperature rising of the base 110 and the diaphragm 210 that contacts the base 110, and the actual temperature can reach about 70° C. The diaphragm 210 is generally prepared by elastic materials such as rubber, and thus the high temperature can produce an irreversible effect on the diaphragm 210, and renders the rapid aging of the diaphragm 210. Therefore, the problems are produced that the diaphragm 210 has a short service life and a high fault rate, and the booster pump 300 has a poor reliability.

In view of this, the present disclosure provides the heat-blocking member 120 in the valve core assembly 200. In an embodiment, the heat-blocking member 120 is fixed on the base 110, and the heat-blocking member 120 is configured to support the diaphragm 210; after assembled, the heat-blocking member 120 is located between the base 110 and the diaphragm 210, and the heat-blocking member 120 keeps contacting the diaphragm 210; when the heat-blocking member 120 moves with the base 110, the diaphragm 210 which keeps contacting the heat-blocking member 120 deforms. The heat-blocking member 120 has a good heat-blocking performance, and thus can slow down the heat transfer efficiency between the base 110 and the diaphragm 210. The heat-blocking member 120 can be prepared by a PA6+30GF material (nylon 66+ 30% glass fiber), or heat-blocking materials such as ceramics, while the present embodiment does not rigidly limit the material of the heat-blocking member 120 as along as it can meet the heat-blocking requirements.

Through disposing the heat-blocking member 120 between the base 110 and the diaphragm 210, the heat transfer efficiency between the base 110 and the diaphragm 210 can be effectively reduced, and the temperature of the diaphragm 210 in the operation process is reduced, and the diaphragm 210 is prevented from being damaged due to the high temperature. Therefore, the problem in the related technologies is solved. The effects are further achieved that the structure of the valve core assembly 200 is optimized, the service life of the diaphragm 210 is prolonged on the basis of satisfying the pumping requirement for high flow rate, the fault rate of the valve core assembly 200 is lowered and the fault rate of the booster pump 300 is lowered.

In the embodiment, the base 110 and the heat-blocking member 120 are separated structures, and through disposing the separated base 110 and heat-blocking member 120, firstly, metal materials with high strength can be selected for the base 110, to ensure that the base 110 can drive the diaphragm 210 to move at a high speed for a long time, and the fault rate of the base 110 is lowered; secondly, the heat-blocking performance of the heat-blocking member 120 can be adjusted through selecting or changing different materials of heat-blocking member 120, and thus, the corresponding material can be selected for the heat-blocking member 120 according to the requirement for the pumping flow rate of the booster pump 300, and therefore, the costs of the valve core assembly 200 are reduced on the basis that the heat-blocking requirement is satisfied.

As shown in FIG. 1, FIG. 2, FIG. 3 and FIG. 4, in at least one embodiment of the present disclosure, the valve core assembly 200 further comprises a positioning member 112, provided at the base 110, and the heat-blocking member 120 is connected to the positioning member 112.

In the embodiment, the valve core assembly 200 is provided with the positioning member 112, the positioning member 112 is disposed on the base 110, and the heat-blocking member 120 is connected to the positioning member 112, and thus the heat-blocking member 120 is positioned on a predetermined mounting position on the base 110. Disposing the positioning member 112 helps improve the positioning accuracy of the heat-blocking member 120 on the base 110, to prevent the heat-blocking member 120 assembled in dislocation from affecting the liquid pumping performance of the valve core assembly 200. Meanwhile, disposing the positioning member 112 can further prevent the heat-blocking member 120 from shaking with respect to the base 110 in the operation process, and thus improve the moving accuracy of the diaphragm 210 to accurately control the liquid pumping efficiency. Moreover, the effects are further achieved that the structure of the valve core assembly 200 is optimized, the stability of the structure of the valve core assembly 200 is improved and the fault rate of the valve core assembly 200 is reduced.

In an embodiment, the positioning member 112 presents a cylindrical shape; the bottom end of the cylindrical positioning member 112 is connected to the base 110, and the top end is connected to the heat-blocking member 120. Disposing a cylindrical positioning column can effectively support the heat-blocking member 120 and the diaphragm 210, and meanwhile, the cylindrical positioning column can increase the distance between the diaphragm 210 and the base 110 and thus prevent the interference between the deformed diaphragm 210 and the base 110. Furthermore, the effects are further achieved that the positioning accuracy of the diaphragm 210 is improved and the fault rate of the diaphragm 210 is reduced.

In any of the above embodiments, there are N positioning members 112, and the N positioning members 112 are arranged uniformly at the base 110; and, N is an integer greater than 2.

In the embodiment, the number of the positioning members 112 is defined. There are N positioning members 112 and N is an integer greater than 2, i.e., at least three positioning members 112 are provided at the base 110. Through disposing at least three positioning members 112, the stability of supporting the heat-blocking member 120 and the diaphragm 210 by the positioning member 112 is ensured, and the possibility that the diaphragm 210 inclines on the valve core assembly 200 is reduced. Configuring the structure of the positioning members 112 on the base 110 can provide convenience for pushing and pulling the diaphragm 210 in the operation process, and can promote the deformation amplitude of the diaphragm 210 and reduce the acting forces required for pushing and pulling the diaphragm 210. Furthermore, the effects are achieved that the pumping flow rate and pumping pressure of the booster pump 300 which uses the valve core assembly 200 are promoted, and the competitiveness of associated products is improved. Through uniformly disposing the N positioning members 112 on the base 110, the uniformity of the distribution of the acting forces between heat-blocking member 120 and the diaphragm 210 can be improved, and the diaphragm 210 is prevented from being damaged due to the uneven stress. The effect is further achieved that the service life of the diaphragm 210 is prolonged.

And, the N positioning members 112 can jointly position and support a single heat-blocking member 120, or respectively support a plurality of heat-blocking members 120, and the present embodiment does not make any rigid definition to the number and the distribution method of the heat-blocking members 120.

In any of the above embodiments, the base 110 presents an annular shape, and the N positioning members 112 are uniformly arranged in the same circle which takes the axis of the base 110 as the axis.

In the embodiment, the arranging method of the positioning members 112 on the base 110 is defined. The base 110 is an annular structure. On the base 110, at least three positioning members 112 are arranged uniformly in the same circle which takes the axis of the base 110 as the axis, to form an array of the positioning members 112 in an annular arrangement on the base 110, body. Through arranging the plurality of positioning members 112 uniformly along a circle on the base 110, the uniformity of the force distribution of the base 110 can be improved, and the diaphragm 210 is prevented from being damaged due to uneven stress. The effects are further achieved that the structure of the base 110 is optimized and the service life of the diaphragm 210 is prolonged.

In any of the above embodiments, there are N heat-blocking members 120, and the N heat-blocking members 120 are connected to the N positioning members 112 in a one-to-one correspondence manner.

In the embodiment, the number of the heat-blocking members 120 and the corresponding relationship between the heat-blocking members 120 and the positioning members 112 are defined. The number of the heat-blocking members 120 is equal to the number of the positioning members 112, and the N positioning members 112 and the N heat-blocking members 120 are arranged in a one-to-one correspondence manner, to form an array of the N heat-blocking members 120 in an annular arrangement on the base 110, and to jointly support the diaphragm 210 through the N heat-blocking members 120. Through disposing the N heat-blocking members 120 corresponding to the N positioning members 112, the contact area between the heat-blocking members 120 and the diaphragm 210 can be decreased on the basis of satisfying the requirements for positioning and connecting the diaphragm 210, to avoid affecting the movement range of the diaphragm 210 due to a large area contact. Moreover, the effects are further achieved that the structure of the valve core assembly 200 is optimized and the pumping performance of the valve core assembly 200 is enhanced.

Figure 8:
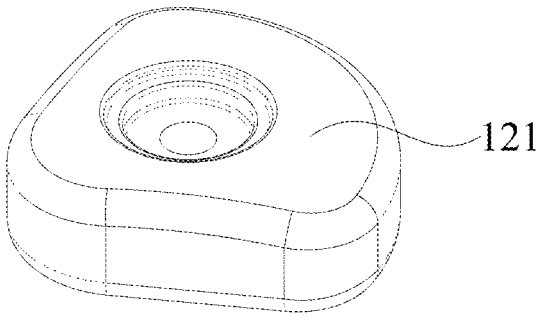
FIG. 8 is a second schematic view of the structure of a heat-blocking member according to an embodiment of the present disclosure.
Figure 9:
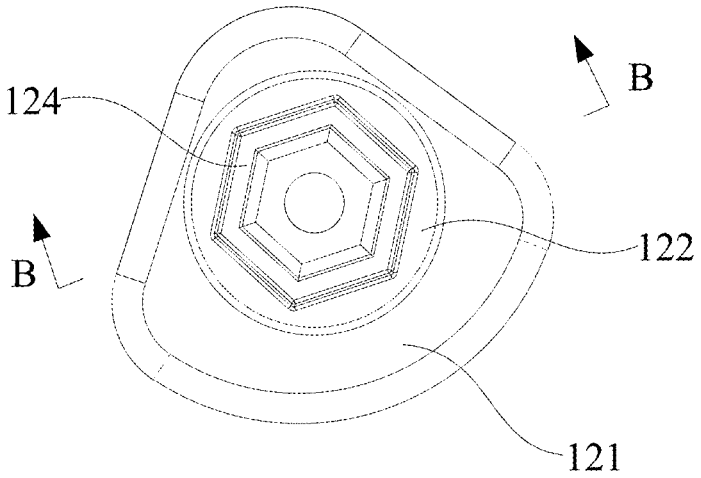
FIG. 9 is a third schematic view of the structure of a heat-blocking member according to an embodiment of the present disclosure.
Figure 10:
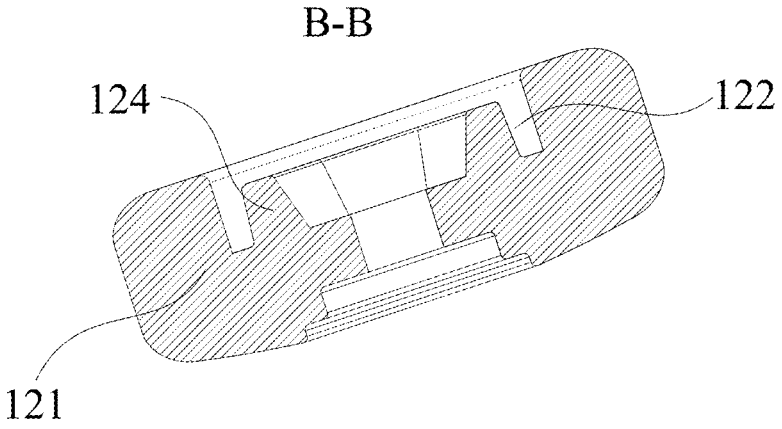
FIG. 10 is a sectional view of the heat-blocking member in the direction B-B in the embodiment as shown in FIG. 9.

As shown in FIG. 3, FIG. 7 and FIG. 8, in at least one embodiment of the present disclosure, the heat-blocking member 120 comprises a mounting groove 122, and the positioning member 112 is inserted in the mounting groove 122.

In the embodiment, the cooperating and connecting structure between the heat-blocking member 120 and the positioning member 112 is defined. The positioning member 112 presents a cylindrical structure, and the mounting groove 122 which has a shape matching the outer contour of the positioning member 112 is provided at the heat-blocking member 120. In the assembling process, the positioning member 112 is firstly aligned with the mounting groove 122, and then is inserted in the mounting groove 122, and thus the assembling of the heat-blocking member 120 is accomplished. Through disposing the mounting groove 122, firstly, the positioning accuracy of the heat-blocking member 120 is improved to ensure that the heat-blocking member 120 can work at a predetermined mounting position, and thus the deformation amount of the diaphragm 210 is accurately controlled to achieve accurate liquid pumping. Secondly, disposing the mounting groove 122 can reduce the difficulty of assembling the heat-blocking member 120 and reduce the complexity of the structure between the heat-blocking member 120 and the positioning member 112. Furthermore, the effects are achieved that the accuracy for positioning the diaphragm 210 is improved, the reliability of liquid pumping of the valve core assembly 200 is enhanced, and the cost of the valve core assembly 200 is reduced.

In any of the above embodiments, the surface of the positioning member 112 facing the heat-blocking member 120 is provided with the guide groove 1122, and the valve core assembly 200 further comprises a protrusion member 124, provided at the heat-blocking member 120, located in the mounting groove 122 and inserted in the guide groove 1122.

In the embodiment, based on the above embodiments, the cooperating structure between the positioning member 112 and the heat-blocking member 120 is further defined. The surface of the positioning member 112 facing the heat-blocking member 120 is provided with the guide groove 1122, i.e., the front-end surface of the cylindrical positioning member 112 is provided with the guide groove 1122, and in the assembling process, the guide groove 1122 needs to be inserted into the mounting groove 122. Correspondingly, the protrusion member 124 is provided in the mounting groove 122, and the shape of the protrusion member 124 matches the shape of the guide groove 1122. In the process of inserting the positioning member 112 into the mounting groove 122, the protrusion member 124 is gradually inserted into the mounting groove 122, to cooperate with the positioning member 112 and the mounting groove 122 to form an embedded type positioning and connecting structure, to improve the positioning accuracy of the heat-blocking member 120. Meanwhile, the embedded type connecting structure can improve the positioning stability of the heat-blocking member 120, and prevent the heat-blocking member 120 from dislocating or even dropping during a long-time reciprocating movement. Moreover, the effects are further achieved that the structure stability of the valve core assembly 200 is improved and the fault rate of the valve core assembly 200 is reduced.

In any of the above embodiments, the positioning member 112 is sectioned by a plane perpendicular to a depth direction of the guide groove 1122, and on the cross-sectional surface, the guide groove 1122 presents a polygon; and the protrusion member 124 fills the guide groove 1122.

In the embodiment, the shapes of the protrusion member 124 and the guide groove 1122 are defined. The guide groove 1122 is opened in the end surface of the cylindrical positioning member 112, the depth direction of the guide groove 1122 is consistent with the axis direction of the cylindrical positioning member 112. On the above basis, the positioning member 112 is sectioned by a plane perpendicular to the depth direction, and the guide groove 1122 on the cross-sectional surface presents a polygon. Correspondingly, the shape of the protrusion member 124 is the same with the shape of the guide groove 1122, and the protrusion member 124 inserted in the guide groove 1122 can fill the guide groove 1122. The shapes of the cross-sections of the guide groove 1122 and the protrusion member 124 are correspondingly disposed to be polygons, and the protrusion member 124 and the guide groove 1122 which are in socket connection can prevent the heat-blocking member 120 from rotating with respect to the positioning member 112 through a shape cooperation relation, to ensure the positioning accuracy of the heat-blocking member 120 and the diaphragm 210 and preventing the dislocation of the heat-blocking member 120 and the diaphragm 210 in the operation process. Meanwhile, through the arrangement that the shapes of the cross-sections of the guide groove 1122 and the protrusion member 124 are disposed to be polygons, it can help position the heat-blocking member 120 in the assembling process and reduce the probability of the misassembling of the position of the heat-blocking member 120. Furthermore, the effects are further achieved that the accuracy and reliability of the positioning of the heat-blocking member 120 are improved, the assembling difficulty of the heat-blocking member 120 is lowered, the assembling accuracy of the heat-blocking member 120 is improved and the yield rate is improved.

In an embodiment, the shapes of the cross-sections of the guide groove 1122 and the protrusion member 124 are both regular polygons, in a further embodiment, the shape of the cross-section of the guide groove 1122 is an equilateral triangle, the protrusion member 124 is a corresponding triangular prism, and the shape of the cross-section of the guide groove 1122 is a regular quadrilateral; the protrusion member 124 is a corresponding quadrangular prism, or the shape of the cross-section of the guide groove 1122 is a regular octagon, and the protrusion member 124 is an octagonal prism. In the operation process, the peripheral side surface of the prism abuts the side wall of the guide groove 1122, to prevent the heat-blocking member 120 from rotating with respect to the positioning member 112. The present embodiment does not rigidly define the shapes of the guide groove 1122 and the protrusion member 124 as long as they can satisfy the above positioning requirements.

In any of the above embodiments, on the cross-section, the guide groove 1122 is a regular hexagon.

In the embodiment, the shape of the cross-section of the guide groove 1122 is a regular hexagon, and correspondingly the protrusion member 124 is a hexagonal prism; the heat-blocking member 120 can be clamped on the positioning member 112 as along as hexagonal prism is inserted into the guide groove 1122. And, the hexagonal prism is provided with a through hole and a connection member 126 passes through the heat-blocking member 120 to connect the base 110.

In an embodiment, the guide groove 1122 is in interference fit with the protruding portion 124, and through disposing the guide groove 1122 and the protrusion member 124 in interference fit with each other, a tight connection between the positioning member 112 and the heat-blocking member 120 can be achieved, and this helps improve the positioning accuracy of the heat-blocking member 120, and prevent the heat-blocking member 120 from dislocating with respect to the positioning member 112 or even escaping from the positioning member 112 in the operation process. Furthermore, the effect is achieved that the stability and reliability of the structure of the valve core assembly 200 are improved.

As shown in FIG. 11, FIG. 1, FIG. 3 and FIG. 7, in at least one embodiment of the present disclosure, in any of the above embodiments, the heat-blocking member 120 is detachably connected to the base 110.

In the embodiment, the heat-blocking member 120 is detachably connected to the base 110. Through disposing the detachable structure, firstly, a modularization design for the base 110 and the heat-blocking member 120 can be achieved, and the heat-blocking member 120 with the corresponding heat-blocking performance is disposed for the base 110 with different pumping efficiencies; secondly, through disposing the detachable heat-blocking member 120, the maintenance for the valve core assembly 200 can be finished rapidly by removing and replacing the heat-blocking member 120 when it is aging or damaged, and this brings convenience for users and reduces the difficulty and costs for product maintenance.

In any of the above embodiments, the valve core assembly 200 further comprises: a compression member 220, provided at the diaphragm 210 and being away from the heat-blocking member 120; and a connection member 126, passing through the diaphragm 210 and connecting the diaphragm 210 with the heat-blocking member 120.

In the embodiment, the valve core assembly 200 is further provided with the compression member 220 and the connection member 126; the compression member 220 is disposed on the diaphragm 210, and the connection member 126 passes through the diaphragm 210 and connects the compression member 220 with the heat-blocking member 120, to compress the diaphragm 210 on the heat-blocking member 120 through the compression member 220, and the diaphragm 210 is tightly attached to the top surface of the heat-blocking member 120, and thus the assembling and clamping of the diaphragm 210 are achieved. And, the diaphragm 210 is a main operation portion in a booster pump 300, and in the operation process, the booster pump 300 drives the diaphragm 210 to move to change the size of the space partitioned by the diaphragm 210, and accomplishes the drawing, pressure boosting and discharging of mediums. Through disposing the connection member 126 and the compression member 220, the diaphragm 210 can be accurately positioned in the booster pump 300, to lower the possibility of dislocating of the diaphragm 210 in the operation process. In addition, the diaphragm 210 can be tightly attached to the base 110 by the compression member 220, and thus this removes the gap between a first positioning surface and the diaphragm 210, and thus improves the movement accuracy of the diaphragm 210 and ensures the pumping efficiency of the valve core assembly 200.

In an embodiment, the connection member 126 passes through the compression member 220 and the diaphragm 210 from one side of the compression member 220, and is connected to the base 110. Through disposing the connection member 126, the compression member 220 can be compressed on the diaphragm 210 through the connection member 126, to prevent a gap appearing between the base 110 and the diaphragm 220. Meanwhile, disposing the connection member 126 can improve the stability of the structure of the valve core assembly 200. Compared with the embodiment in which a limit structure is disposed to compress the compression member 220, disposing a penetrating connection member 126 can improve the stability and the reliability of the positioning of the diaphragm 210 and reduce the possibility of the dislocating or dropping of the diaphragm 210.

As shown in FIG. 11 and FIG. 12, at least one embodiment of the present disclosure provides a booster pump 300, and the booster pump 300 comprises: a housing 310 having a cavity; the valve core assembly 200 in any of the above embodiments, provided in the cavity, and the diaphragm 210 is connected to the housing 310, and the cavity is partitioned by the diaphragm 210.

In the embodiment, the booster pump 300 provided with the valve core assembly 200 in any of the above embodiments is defined, and thus the booster pump 300 has the advantages of the valve core assembly 200 in any of the above embodiments, and can achieve the effect that the valve core assembly 200 in any of the above embodiments achieves, which are not described herein for avoiding repetition.

In an embodiment, the booster pump 300 comprises the housing 310, and the housing 310 is an external frame structure of the booster pump 300, and configured to enclose and define the cavity. The base 110 and the compression member 220 are disposed in the cavity, and position the diaphragm 210 in the housing 310. And, the peripheral side of the diaphragm 210 is connected to the inner wall of the housing 310, to partition the cavity into two sub-cavities; the base 110 and the compression member 220 are respectively located in the sub-cavities at the two sides of the diaphragm 210. When the base 110 drives a portion of the diaphragm 210 and the compression member 220 to move with respect to the housing 310, the diaphragm 210 connected to the housing 310 is pushed and pulled, and thus deformed. In a pulling process, the volume of the sub-cavity where the compression member 220 is located increases, and the booster pump 300 can absorb mediums into the sub-cavity. When the diaphragm 210 is pushed by the base 110 towards the direction of the compression member 220, the volume of the sub-cavity where the compression member 220 is located decreases, and the mediums in the sub-cavity is pushed out of the booster pump 300. Furthermore, the booster pump 300 achieves medium pumping.

In any of the above embodiments, the housing 310 further comprises an inlet and an outlet, and the inlet and the outlet communicate with the cavity at the side of the diaphragm 210 away from the base 110; the booster pump 300 further comprises: a drive assembly 250, connected to the base 110 and configured to drive the base 110 to swing with respect to the housing 310.

In the embodiment, the housing 310 is further provided with the inlet and the outlet for the entering and exiting of the mediums. Both the inlet and the outlet communicate with the sub-cavity at one side of the diaphragm 210. The base 110 and a drive member 256 are provided in the sub-cavity at the side away from the inlet and the outlet. The drive assembly 250 is fixed on the housing 310, and the base 110 connects the drive assembly 250 and the diaphragm 210. When the booster pump 300 operates, the drive assembly 250 drives the base 110 and the compression member 220 to move with respect to the housing 310, to achieve the absorbing and discharging of the mediums through pushing and pulling the diaphragm 210.

In any of the above embodiments, the drive assembly 250 comprises: a drive member 256 having a drive shaft 252; an eccentric wheel 230, sleeved on the drive shaft 252; a bearing 254, and the inner ring of the bearing 254 is sleeved on the eccentric wheel 230, and the outer ring of the bearing 254 passes through the base 110.

In the embodiment, the structure of the drive assembly 250 is defined. The drive assembly 250 comprises the drive member 256, the eccentric wheel 230 and the bearing 254. The eccentric wheel 230 and the bearing 254 are transmission structures between the base 110 and the drive member 256; the bearing 254 is sleeved on the shaft body 232 of the eccentric wheel 230, and the base 110 is sleeved on the outer side of the bearing 254. In the operation process, the eccentric wheel 230 rotates about a first axis, while a first included angle is formed between the axis of the shaft body 232 and the first axis, and the base 110 which is sleeved on the shaft body 232 can rotate eccentrically around the first axis at the same time. The diaphragm 210 is provided at the base 110 and connected to the base 110. The diaphragm 210 is made of elastic materials and thus can deform when it is pushed and pulled, and thus the volume of the cavity in the booster pump 300 is changed, in some embodiments, when the diaphragm 210 is pulled outwards, the volume of the cavity increases, and on the contrary, when the diaphragm 210 restores its original state or is pushed inwards, the volume of the cavity decreases, and thus, the drawing and pumping of the liquids are achieved through the pushing and pulling.

At least one embodiment of the present disclosure provides a water purifier, and the water purifier comprises the booster pump 300 in any of the above embodiments.

In the embodiment, the water purifier provided with the booster pump 300 in any of the above embodiments is defined, and thus the water purifier has the advantages of the booster pump 300 in any of the above embodiments, and can achieve the effect that the booster pump 300 in any of the above embodiments achieves, which are not described herein for avoiding repetition.

As shown in FIG. 13, FIG. 14, FIG. 15 and FIG. 16, at least one embodiment of the present disclosure provides a valve core assembly 200, and the valve core assembly 200 comprises the eccentric wheel 230 which can rotate with a first axis as the axis and has a shaft body 232, and a first included angle is formed between the axis of the shaft body 232 and the first axis; a support mechanism 100, sleeved on the shaft body 232; a diaphragm 210, connected to the support mechanism 100; and the surface of the support mechanism 100 contacting the diaphragm 210 is a contact surface 116, and the contact surface 116 extends towards a direction away from the diaphragm 210 in the radial direction of the shaft body 232 from outside to inside.

The valve core assembly 200 proposed in the present disclosure can be applied in the booster pump 300; in the operation process, the movement of the valve core assembly 200 is transformed into the change of the volume of the cavity in the booster pump 300, and the liquids can be pressurized into the cavity by a negative pressure when the volume of the cavity increases, and on the contrary, when the volume of the cavity reduces, the liquids are discharged out of the cavity. The valve core assembly 200 comprises the eccentric wheel 230, the support mechanism 100 and the diaphragm 210; the support mechanism 100 is a frame structure of the valve core assembly 200 and configured to position and support other operating structures on the valve core assembly 200. The eccentric wheel 230 is a transmission structure between the support mechanism 100 and the drive member 256. The support mechanism 100 is sleeved on the shaft body 232 of the eccentric wheel 230. In the operation process, the eccentric wheel 230 rotates around a first axis, while a first included angle is formed between the axis of the shaft body 232 and the first axis, and thus the support mechanism 100 which is sleeved on the shaft body 232 can rotate eccentrically around the first axis at the same time. The diaphragm 210 is provided at the support mechanism 100 and connected to the support mechanism 100. The diaphragm 210 is made of elastic materials and thus can deform when it is pushed and pulled, and then the volume of the cavity in the booster pump 300 is changed, in some embodiments, when the diaphragm 210 is pulled outwards, the volume of the cavity increases; on the contrary, when the diaphragm 210 restores its original state or is pushed inwards, the volume of the cavity reduces, and thus, the drawing and pumping of the liquids are achieved through the pushing and pulling.

And at least a portion of the support mechanism 100 is annular, and the axis of the structure of the portion of annular support mechanism 100 is the axis of the support mechanism 100. In the operation process, the support mechanism 100 is driven by the eccentric wheel 230 to rotate about a first axis preset in the valve core assembly 200, and an included angle is formed between the first axis and the axis of the support mechanism 100, to form the eccentrical rotation of the support mechanism 100. In the process of eccentric rotation, the outer surface of the support mechanism 100 can move back and forth in the direction of the first axis, and thus drives a portion of the diaphragm 210 connected to the support mechanism 100 to move back and forth in the direction of the first axis. As the diaphragm 210 has stretchability, in the process that a portion of the diaphragm 210 is pushed and pulled by the support mechanism 100, the shape of the diaphragm 210 changes regularly and thus the drawing and pushing of the liquids are accomplished through the deformed diaphragm 210.

And the larger the first included angle is, the stronger the liquid pumping ability of the valve core assembly 200 is, and for the booster pump 300, the pumping flow rate is larger, while correspondingly, the dynamic load on the moving valve core assembly 200 in the direction of the first axis is larger; since the support mechanism 100 rotates eccentrically, the dynamic load mainly is a radial load, and the radial direction indicates the direction perpendicular to the first axis. In one reciprocating movement cycle of the support mechanism 100, the radial load on the end point on the moving path of the support mechanism 100 is maximum.

Figure 15:
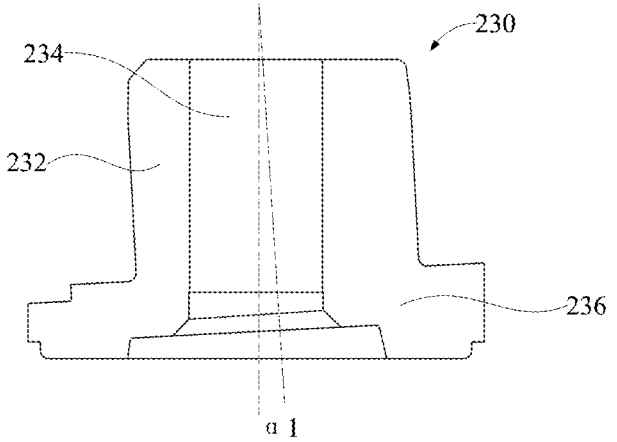
FIG. 15 is a first schematic view of the structure of an eccentric wheel according to an embodiment of the present disclosure.

And, the vertical dash dot line in FIG. 15 is the first axis, the dash dot line which is inclined with respect to the first axis is the axis of the shaft body 232, and a 1 is the first included angle.

In related technologies, in the process that the valve core in the booster pump achieves the liquid pumping through eccentric rotation, the valve core which rotates eccentrically will generates vibration due to the radial load. The vibration trend will produce noises that affect users' experience. And, the larger the pumping flow rate of the booster pump 300 is and the larger the pumping pressure is, the larger the above radial load is, and the booster pump 300 with a high power and a high flow rate will generate a relatively obvious vibration in the operation process, and an excessive vibration will decrease the service life of the valve core and the booster pump 300; moreover, if the vibration trend is transmitted to the application product of the booster pump 300, a relatively high noise will be produced and damage users' experience.

In view of this, the shape of the support mechanism 100 in the present disclosure is improved. In an embodiment, the diaphragm 210 is positioned at the front end of the support mechanism 100, the surface on the support mechanism 100 which contacts the diaphragm 210 is the contact surface 116, and the contact surface 116 can a single annular surface, or multiple planes. And, the contact surface 116 extends along a direction away from the diaphragm 210 in the radial direction of the shaft body 232 from outside to inside. The radial direction is the radial direction of the shaft body 232 and the annular support mechanism 100, the direction from outside to inside indicates the direction extending from the outer peripheral side of the support mechanism 100 to the axis of the support mechanism 100, to form the contact surface 116 which is higher at the outer side and is lower at the inner side in the radial direction from outside to inside. Through disposing the contact surface 116 with a higher outside and a lower inside, the contact surface 116 can compensate in a certain degree the eccentric angle, i.e., the first included angle, of the support mechanism 100 which rotates eccentrically, and thus, through reducing the radial load on the support mechanism 100 in the reciprocating movement, the vibration that the valve core assembly 200 generates in the operation process is reduced, to solve the problems of a relatively high vibration noise and the poor reliability. Furthermore, the effects are achieved that the structure of the valve core assembly 200 is optimized, the operating stability and the structural reliability of the valve core assembly 200 are improved, the operation noises of the product is lowered, the service life of the product is prolonged and the users' experience is improved.

Figure 14:
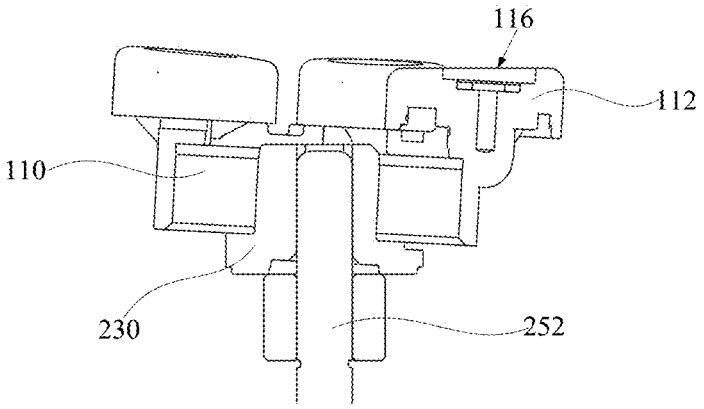
FIG. 14 is a third schematic view of the structure of a valve core assembly according to an embodiment of the present disclosure.
Figure 16:
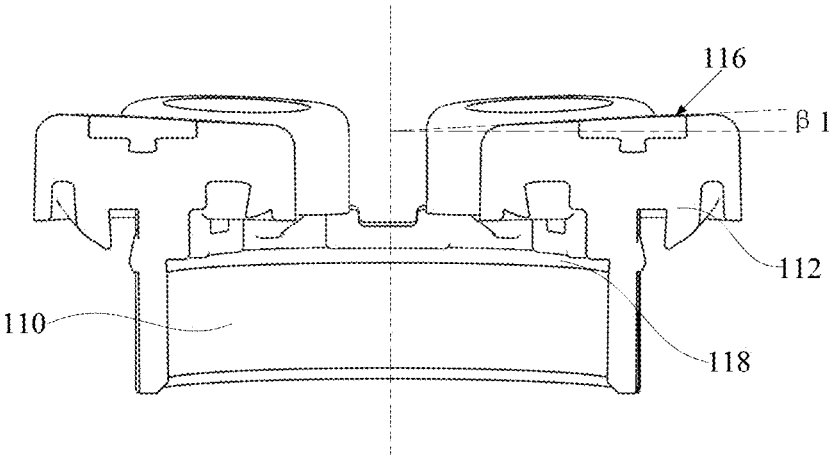
FIG. 16 is a third schematic view of the structure of a support mechanism according to an embodiment of the present disclosure.

As shown in FIG. 14, FIG. 15 and FIG. 16, in at least one embodiment of the present disclosure, the contact surface 116 is a plane, the plane which is perpendicular to the axis of the support mechanism 100 is a reference surface; and a second included angle β1 is formed between the reference surface and the contact surface 116.

In the embodiment, the contact surface 116 is further described. The contact surface 116 is a plane, and the height of the contact surface 116 lowers gradually in the radial direction of the support mechanism 100 from outside to inside, to form a planar contact surface 11 on the support mechanism 100 inclined towards the central area of the support mechanism 100. Under this condition, a plane which is perpendicular to the axis of the support mechanism 100 is taken as the reference surface, and the included angle between the reference surface and the contact surface 116 is the second included angle; the second included angle is a structural compensation angle of the first included angle; through adjusting the degree of the second included angle, the radial load on the support mechanism 100 in the reciprocating movement process can be adjusted. Compared with the embodiment in which an irregular contact surface 116 is disposed to compensate the first included angle, for disposing the contact surface 116 to be a plane, firstly, the structural compensation rate can be improved, and this helps lower the radial load on the support mechanism 100. Secondly, it helps improve the stress uniformity on the diaphragm 210 and helps prolong the service life of the diaphragm 210. Furthermore, the effects are achieved that the structure of the support mechanism 100 is optimized, the operation stability of the support mechanism 100 is improved, the noises generated during the vibration of the product is lowered, and the service life of the product is prolonged.

And, in FIG. 16, the vertical dash dot line is the axis of the support mechanism 100, the dash dot line which is perpendicular to the vertical dash dot line is configured to indicate the reference surface, and β1 is the second included angle.

In any of the above embodiments, the degree of the first included angle is the first angle, and the degree of the second included angle is the second angle; and, the second angle is the product of N and the first angle, and $0.5 \leq N \leq 1.5$.

In the embodiment, the relationship between the first included angle and the second included angle is defined. The degree of the first included angle is the first angle, and the degree of the second included angle is the second angle. The second included angle=N×the first included angle. And, the numeric range of N is greater than or equal to 0.5, and less than or equal to 1.5. Through limiting that the second angle is greater than or equal to 0.5 time of the first included angle, the effectiveness of the radial stress compensation can be ensured, and it is prevented that the compensation effect is lost as the second included angle is too small. Correspondingly, through limiting that the second angle is less than or equal to 1.5 times of the first included angle, it can prevent the inclinedly arranged contact surface 116 from excessively compensating the radial load, and prevent the appearance of the radial load on the support mechanism which has a direction opposite to the direction of the original radial load. Meanwhile, through limiting the magnitude relationship between the first angle and the second angle, the component force of the support mechanism 100 in the radial direction can be reduced at the end point, i.e., at the maximum pressure point, of the stroke of the reciprocating movement of the support mechanism 100, to inhibit the vibration trend of the support mechanism 100. Furthermore, the effects are achieved that the structure of the support mechanism 100 is optimized, the rotation stability of the support mechanism 100 is improved, the noises generated during the vibration of the product is lowered, and the service life of the valve core assembly 200 is prolonged.

Figure 13:
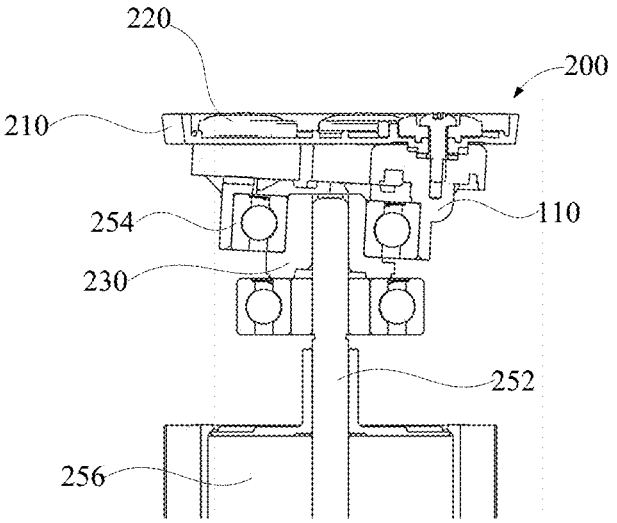
FIG. 13 is a second schematic view of the structure of a valve core assembly according to an embodiment of the present disclosure.

As shown in FIG. 13, FIG. 15 and FIG. 16, in at least one embodiment of the present disclosure, the valve core assembly 200 further comprises: an eccentric wheel 230, connected to the support mechanism 100, and the axis of the eccentric wheel 230 coincides with the axis of a rotating shaft; and a shaft hole 234, provided in the eccentric wheel 230, and the axis of the shaft hole 234 coincides with the first axis.

In the embodiment, the eccentric wheel 230 comprises a cylindrical shaft body 232 and the shaft hole 234 provided in the shaft body 232, and the axis of the shaft body 232 is the axis of the eccentric wheel 230. The support mechanism 100 is sleeved on the eccentric wheel 230, and the axis of the support mechanism 100 coincides with the axis of the eccentric wheel 230. In the operation process, the eccentric wheel 230 rotates by taking the axis of the shaft hole 234 as the axis; under a shape matching relationship, the eccentric wheel 230 drives the support mechanism 100 to rotate about the axis, i.e., the first axis, of the shaft hole 234 at the same time, to help push and pull the diaphragm 210 through the eccentrical rotation of the support mechanism 100. Through disposing the eccentric wheel 230, the eccentrical rotation of the support mechanism 100 can be formed through the contact cooperation between the embedded structures, and the cooperation structure has a relatively high compactness and a relatively strong reliability, helps reduce rotation errors caused by the gaps of the structures, and helps reduce the noises caused by the vibration of the valve core assembly 200. In addition, the structure occupies a relatively small space, and can reduce the difficulty in arranging the valve core assembly 200 inside the booster pump 300, and helps achieve the lightweight design and miniaturization design of the booster pump 300.

Meanwhile, the difficulty in disassembling and assembling the structure is relatively low; when the support mechanism 100 or the eccentric wheel 230 fails, users can conveniently accomplish the maintenance and replacement of the structure through disassembling and assembling. Furthermore, the effects are achieved that the compactness of the structure of the valve core assembly 200 is improved, the size of the valve core assembly 200 is reduced, and the stability and the reliability of the valve core assembly 200 during the operation are improved.

In any of the above embodiments, the valve core assembly 200 further comprises: a bearing 254, sleeved on the eccentric wheel 230, and the support mechanism 100 is sleeved on the bearing 254.

In the embodiment, the valve core assembly 200 is further provided with the bearing 254. The bearing 254 is sleeved on the shaft body 232 of the eccentric wheel 230, the support mechanism 100 is sleeved on the bearing 254, and then the eccentric wheel 230, the bearing 254 and the support mechanism 100 which are embedded sequentially from inside to outside are formed. Through disposing the bearing 254 between the support mechanism 100 and the eccentric wheel 230, the rotating connection between the support mechanism 100 and the eccentric wheel 230 can be achieved. Thus, the relative rotating trend between the support mechanism 100 and the diaphragm 210 is eliminated on the basis of maintaining the radial movement of the support mechanism 100. Disposing the bearing 254 helps reduce the frictional force between the eccentric wheel 230 and the support mechanism 100, and reduce the torque that the support mechanism 100 applies to the diaphragm 210, and prevent the diaphragm 210 from being twisted and torn by the support mechanism 100. Meanwhile, disposing the bearing 254 can further improve the stability and reliability of the transmission between the eccentric wheel 230 and the support mechanism 100, and can inhibit in a certain degree the vibration of the valve core assembly 200 and reduce the noise of the support mechanism 100 during the operation. Furthermore, the effects are achieved that the structure of the valve core assembly 200 is optimized, the stability of the valve core assembly 200 during the operation is improved and the fault rate of the valve core assembly 200 is reduced.

In any of the above embodiments, the valve core assembly 200 further comprises: a first convex rib 118, provided at the support mechanism 100; a second convex rib 236, provided at the eccentric wheel 230, and the two end surfaces of the bearing 254 respectively abut the first convex rib 118 and the second convex rib 236.

In the embodiment, based on the above embodiments, the positioning structure of the bearing 254 is defined. The first convex rib 118 is provided at the inner annular surface of the support mechanism 100, and the second convex rib 236 is provided at the peripheral side surface of the shaft body 232. After assembled, one of the end surfaces of the bearing 254 leans against the first convex rib 118, the other opposite end surface leans against the second convex rib 236, to limit the bearing 254 between the support mechanism 100 and the eccentric wheel 230. In the assembling process, firstly, the bearing 254 is sleeved on the shaft body 232, until the lower end surface of the shaft body 232 leans against the second convex rib 236; then the support mechanism 100 is sleeved on the outer side of the bearing 254, until the first convex rib 118 leans against the upper end surface of the bearing 254. Through disposing the first convex rib 118 and the second convex rib 236, the bearing 254 is prevented from jumping between the support mechanism 100 and the eccentric wheel 230, to lower the vibration and noise generated by the valve core assembly 200 in the operation process. Furthermore, the effects are achieved that the transmission structure of the support mechanism 100 is optimized, the stability and reliability of the eccentric rotation of the support mechanism 100 is improved, and the noise caused by the vibration of products is reduced.

In any of the above embodiments, the valve core assembly 200 further comprises: a drive shaft 252, passing through a shaft hole 234; and a drive member 256, connected to the drive shaft 252.

In the embodiment, the valve core assembly 200 is further provided with the drive shaft 252 and the drive member 256. The drive member 256 can be a motor, and the power output shaft of the drive member 256 is connected to one end of the drive shaft 252 through a coupling, to drive the drive shaft 252 to rotate. The other end of the drive shaft 252 passes through the shaft hole 234 of the eccentric wheel 230, and is connected to the eccentric wheel 230. The drive shaft 252 can be connected to the eccentric wheel 230 through a positioning key and a key groove, or the axial connection between the drive shaft 252 and the eccentric wheel 230 can be accomplished through the arrangement that the shapes of the cross-sections of the shaft hole 234 and the drive shaft 252 are polygons, while the connecting method is not limited herein, as long as the drive shaft 252 can drive the eccentric wheel 230 to rotate synchronously. In the operation process, the power output from the drive member 256 is transferred to the support mechanism 100 through the drive shaft 252, the eccentric wheel 230 and the bearing 254, and the support mechanism 100 rotates eccentrically about the axis, i.e., the first axis, of the drive shaft 252, and the support mechanism 100 that rotates eccentrically pushes and pulls the diaphragm 210 to accomplish the liquid pumping.

Figure 17:
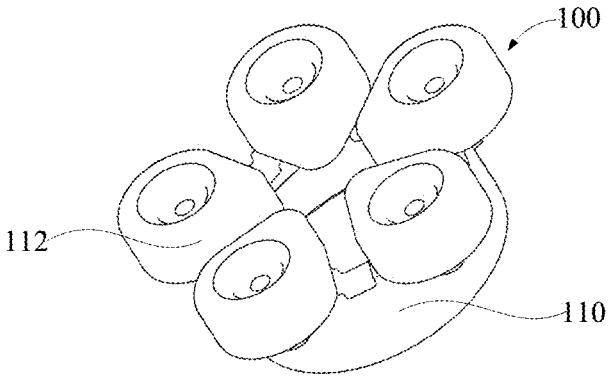
FIG. 17 is a fourth schematic view of the structure of a support mechanism according to an embodiment of the present disclosure.

As shown in FIG. 13, FIG. 16 and FIG. 17, in at least one embodiment of the present disclosure, the support mechanism 100 comprises: a base 110, and the base 110 presents an annular shape; at least three positioning members 112, arranged at the base 110, and a diaphragm 210 is connected to the end surface of the positioning member 112.

In the embodiment, the structure of the support mechanism 100 is described in detail. The support mechanism 100 comprises the base 110 and the positioning member 112. The base 110 is the main frame structure of the support mechanism 100, and configured to position and support the positioning member 112 provided at the base 110. The positioning member 112 is provided at the base 110, and a first positioning surface is located on the end surface of the positioning member 112. When the diaphragm 210 is assembled, the diaphragm 210 is placed on the positioning member 112, and then the assembling is accomplished when the diaphragm 210 is connected to the positioning member 112, and the surface on the positioning member 112 which contacts the diaphragm 210 is the contact surface 116; when the contact surface 116 is a plane, the contact surface 116 on each positioning member 112 inclines towards the direction of the base 110, to form an array of the contact surfaces 116 with a higher outside and a lower inside. The bearing 254 passes through the base 110, the side wall of the bearing is disposed opposite to the inner annular surface of the base 110, and the first convex rib 118 is provided at the base 110 and located between the lower end surface of the base 110 and the positioning member 112.

And, there are at least three positioning members 112, to ensure the stability of the positioning member 112 in supporting the diaphragm 210, and lower the possibility that the diaphragm 210 inclines on the valve core assembly 200. Through configuring the structure of the positioning members 112 on the support mechanism 100, it can provide convenience for pushing and pulling the diaphragm 210 in the operation process, and can increase the deformation amplitude of the diaphragm 210 and reduce the acting forces required for pushing and pulling the diaphragm 210. Furthermore, the effects are achieved that the structure of the support mechanism 100 is optimized, the pumping flow rate and the pumping pressure of the booster pump 300 which uses the valve core assembly 200 are promoted, and the competitiveness of associated products is improved.

In any of the above embodiments, the contact surfaces 116 of at least three positioning members 112 intersect at the same intersection point, and the intersection point is located on the axis of the base 110.

In the embodiment, based on the above embodiments, the contact surfaces 116 are planes, and the contact surfaces 116 on each positioning member 112 incline towards the direction of the base 110. On this basis, through defining that the contact surfaces 116 of the at least three positioning members 112 intersect at the same intersection point and defining that the intersection point is located on the axis of the base 110, an array of multiple contact surfaces 116 arranged by the same method is formed on the positioning members 112. Thus, the direction of the mutual acting force between the diaphragm 210 and the support mechanism 100 is optimized, and this helps reduce the join force of the support mechanism 100 in the radial direction which is perpendicular to the first axis, and thus promotes the compensation effect of the inclined contact surface 116 to the eccentrical rotation of the support mechanism 100, and lowers the radial load on the support mechanism 100. Furthermore, the effects are achieved that the structure of the support mechanism 100 is optimized, the stability of the rotation of the support mechanism 100 is improved, the noise caused by the vibration of products is lowered, and the users' experience is improved.

In any of the above embodiments, at least three positioning members 112 are arranged uniformly at the base 110 in the same circle which takes the axis of the base 110 as the axis.

In the embodiment, the arranging method of the positioning members 112 on the support mechanism 100 is defined. The base 110 is an annular structure. On the base 110, at least three positioning members 112 are arranged uniformly in the same circle which takes the axis of the base 110 as the axis, to form an array of the positioning members 112 in an annular arrangement on the base 110. Through arranging the plurality of positioning members 112 uniformly along a circle on the base 110, the uniformity of the force distribution between the support mechanism 100 and the diaphragm 210 can be improved, and the diaphragm 210 is prevented from being damaged due to uneven stress. The effects are further achieved that the structure of the base 110 is optimized and the service life of the diaphragm 210 is prolonged.

In any of the above embodiments, the valve core assembly 200 further comprises: a compression member 220, provided at the side of the diaphragm 210 away from the positioning member 112, abutting the diaphragm 210, and configured to compress the diaphragm 210 on the positioning member 112.

In the embodiment, the valve core assembly 200 is further provided with the compression member 220, and the compression member 220 is provided at the diaphragm 210. After assembled, the compressing member 220 leans against the diaphragm 210, and the diaphragm 210 is compressed between the support mechanism 100 and the compression member 220, to achieve the assembling and clamping of the diaphragm 210. And, the diaphragm 210 is the main operating portion of the booster pump 300, and in the operation process, the booster pump 300 drives the diaphragm 210 to move and the size of the space partitioned by the diaphragm 210 changes, to accomplish the drawing, pressure boosting and discharging of mediums. Through disposing the support mechanism 100 and the compression member 220, the diaphragm 210 can be positioned accurately in the booster pump 300, to lower the possibility of the dislocation of the diaphragm 210 in the operation process. In addition, the compression member 220 can compress the diaphragm 210 on the support mechanism 100, thereby eliminating the gap between the first positioning surface and the diaphragm 210.

In any of the above embodiments, the number of the compression members 220 is equal to the number of the positioning members 112, and the compression members 220 and the positioning member 112 are arranged in a one-to-one correspondence manner.

In the embodiment, the structure of the compression members 220 is described in detail. Each valve core assembly 200 is provided with multiple compression members 220, and the number of the compression members 220 is equal to the number of the positioning members 112 on the base 110. In the assembling process, firstly, the diaphragm 210 is aligned with and placed on at least three positioning members 112. Then, one compression member 220 is provided correspondingly for each positioning member 112 at the side of the diaphragm 210 away from the support mechanism 100, and the compression member 220 is compressed on the diaphragm 210, and the diaphragm 210 is compressed on the positioning portion 112 by the compression member 220.

Through defining the above structure, firstly, the stability for positioning the diaphragm 210 by the valve core assembly 200 can be improved by disposing multiple compression members 220, and the possibility that the diaphragm 210 is dislocated between the support mechanism 100 and the compression member 220 is reduced. Secondly, the structure can provide convenience for the valve core assembly 200 in pushing and pulling the diaphragm 210 in the operation process, and can increase the deformation amplitude of the diaphragm 210 and reduce the acting forces required for pushing and pulling the diaphragm 210. Furthermore, the effects are achieved that the structure of the valve core assembly 200 is optimized, the pumping flow rate and the pumping pressure of the booster pump 300 which uses the valve core assembly 200 are promoted, and the competitiveness of associated products is improved.

Figure 18:
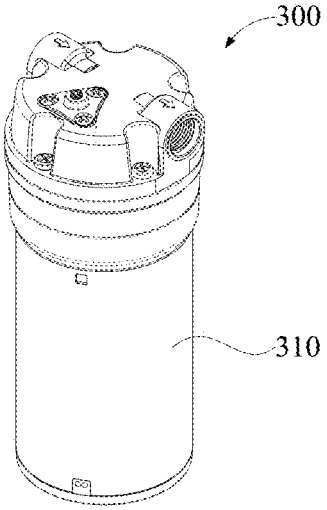
FIG. 18 is a second schematic view of the structure of a booster pump according to an embodiment of the present disclosure.

As shown in FIG. 18, at least one embodiment of the present disclosure provides a booster pump 300, and the booster pump 300 comprises: a housing 310 having a cavity; the valve core assembly 200 in any of the above embodiments, provided in the cavity, and the diaphragm 210 is connected to the housing 310, and the cavity is partitioned by the diaphragm 210.

In the embodiment, the booster pump 300 provided with the valve core assembly 200 in any of the above embodiments is defined, and thus the booster pump 300 has the advantages of the valve core assembly 200 in any of the above embodiments, and can achieve the effect that the valve core assembly 200 in any of the above embodiments achieves, which are not described herein for avoiding repetition.

In an embodiment, the booster pump 300 comprises the housing 310, and the housing 310 is an external frame structure of the booster pump 300, and configured to enclose and define the cavity. The support mechanism 100 and the compression member 220 are disposed in the cavity, and position the diaphragm 210 in the housing 310. And, the peripheral side of the diaphragm 210 is connected to the inner wall of the housing 310, to partition the cavity into two sub-cavities; the support mechanism 100 and the compression member 220 are respectively located in the sub-cavities at the two sides of the diaphragm 210. When the support mechanism 100 drives a portion of the diaphragm 210 and the compression member 220 to move with respect to the housing 310, the diaphragm 210 connected to the housing 310 is pushed and pulled, and thus deformed. In a pulling process, the volume of the sub-cavity where the compression member 220 is located increases, and the booster pump 300 can absorb mediums into the sub-cavity. When the diaphragm 210 is pushed by the support mechanism 100 towards the direction of the compression member 220, the volume of the sub-cavity where the compression member 220 is located decreases, and the mediums in the sub-cavity is pushed out of the booster pump 300. Furthermore, the booster pump 300 achieves medium pumping.

In any of the above embodiments, the housing 310 further comprises an inlet and an outlet, and the inlet and the outlet communicate with the cavity at the side of the diaphragm 210 away from the support mechanism 100.

In the embodiment, the housing 310 is provided with the inlet and the outlet for the entering and exiting of the mediums. Both the inlet and the outlet communicate with the sub-cavity at one side of the diaphragm 210. The support mechanism 100 and the drive member 256 are provided in the sub-cavity at the side away from the inlet and the outlet. The drive member 256 is fixed on the housing 310, and the support mechanism 100 connects the drive member 256 and the diaphragm 210. When the booster pump 300 operates, the drive member 256 drives the support mechanism 100 and the compression member 220 to move with respect to the housing 310, to achieve the absorbing and discharging of the mediums through pushing and pulling the diaphragm 210.

At least one embodiment of the present disclosure provides a water purifier, and the water purifier comprises the booster pump 300 in any of the above embodiments.

In the embodiment, the water purifier provided with the booster pump 300 in any of the above embodiments is defined, and thus the water purifier has the advantages of the booster pump 300 in any of the above embodiments, and can achieve the effect that the booster pump 300 in any of the above embodiments achieves, which are not described herein for avoiding repetition.

Figure 19:
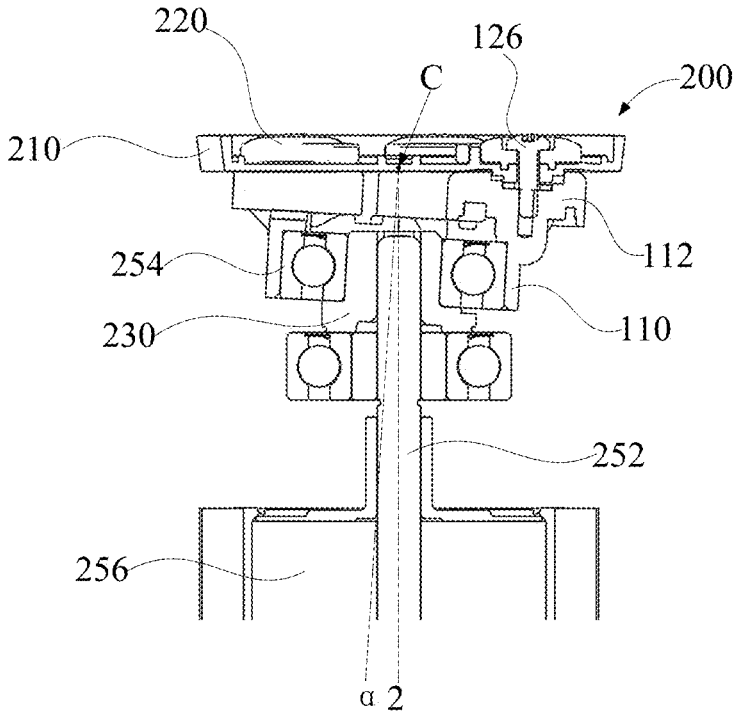
FIG. 19 is a fourth schematic view of the structure of a valve core assembly according to an embodiment of the present disclosure.
Figure 20:
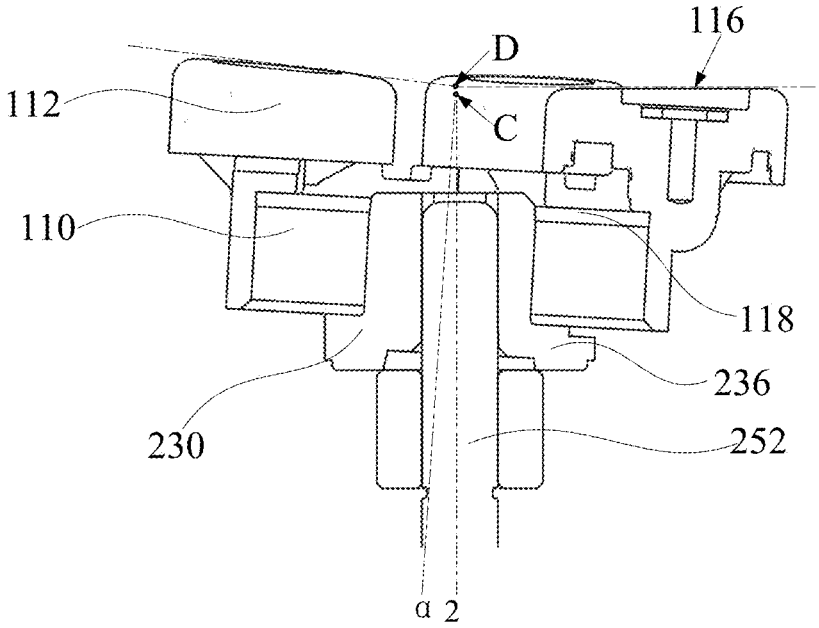
FIG. 20 is a fifth schematic view of the structure of a valve core assembly according to an embodiment of the present disclosure.
Figure 21:
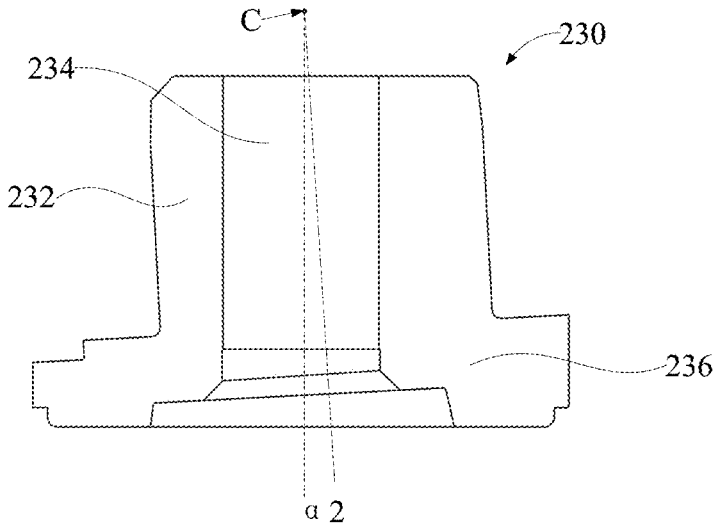
FIG. 21 is a second schematic view of the structure of an eccentric wheel according to an embodiment of the present disclosure.
Figure 22:
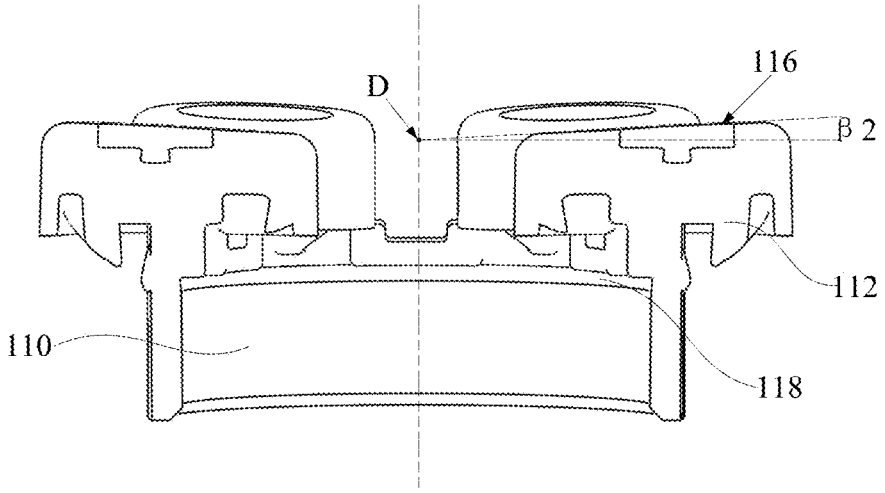
FIG. 22 is a fifth schematic view of the structure of a support mechanism according to an embodiment of the present disclosure.

As shown in FIG. 19, FIG. 20 and FIG. 22, at least one embodiment of the present disclosure provides a valve core assembly 200, and the valve core assembly 200 comprises the eccentric wheel 230 which can rotate with a first axis as the axis and has a shaft body 232, and a third included angle is formed between the axis of the shaft body 232 and the first axis, as shown in FIG. 19 and FIG. 21, a 2 shows the third included angle; a support mechanism 100, sleeved on the shaft body 232; a diaphragm 210, connected to the support mechanism 100; and, the intersection point of the first axis and the axis of the shaft body 232 is the first intersection point, as shown in FIG. 19, FIG. 20 and FIG. 21, C shows the first intersection point; and the first intersection point is located on the surface of the diaphragm 210 or within the diaphragm 210.

The valve core assembly 200 proposed in the present disclosure can be applied in the booster pump 300; in the operation process, the movement of the valve core assembly 200 is transformed into the change of the volume of the cavity in the booster pump 300, and the liquids can be pressurized into the cavity by a negative pressure when the volume of the cavity increases, and on the contrary, when the volume of the cavity reduces, the liquids are discharged out of the cavity. The valve core assembly 200 comprises the eccentric wheel 230, the support mechanism 100 and the diaphragm 210; the support mechanism 100 is a frame structure of the valve core assembly 200 and configured to position and support other operating structures on the valve core assembly 200. The eccentric wheel 230 is a transmission structure between the support mechanism 100 and the drive member 256. The support mechanism 100 is sleeved on the shaft body 232 of the eccentric wheel 230. In the operation process, the eccentric wheel 230 rotates around a first axis, while a third included angle is formed between the axis of the shaft body 232 and the first axis, and thus the support mechanism 100 which is sleeved on the shaft body 232 can rotate eccentrically around the first axis at the same time. The diaphragm 210 is provided at the support mechanism 100 and connected to the support mechanism 100.

The diaphragm 210 is made of elastic materials and thus can deform when it is pushed and pulled, and then the volume of the cavity in the booster pump 300 is changed, in some embodiments, when the diaphragm 210 is pulled outwards, the volume of the cavity increases; on the contrary, when the diaphragm 210 restores its original state or is pushed inwards, the volume of the cavity reduces, and thus, the drawing and pumping of the liquids are achieved through the pushing and pulling. And, at least a portion of the support mechanism 100 is annular, and the axis of the structure of the portion of annular support mechanism 100 is the axis of the support mechanism 100. In the operation process, the support mechanism 100 is driven by the eccentric wheel 230 to rotate about a first axis preset in the valve core assembly 200, and an included angle is formed between the first axis and the axis of the support mechanism 100, to form the eccentrical rotation of the support mechanism 100.

In the process of eccentric rotation, the outer surface of the support mechanism 100 can move back and forth in the direction of the first axis, and thus drives a portion of the diaphragm 210 connected to the support mechanism 100 to move back and forth in the direction of the first axis. As the diaphragm 210 has stretchability, in the process that a portion of the diaphragm 210 is pushed and pulled by the support mechanism 100, the shape of the diaphragm 210 changes regularly and thus the drawing and pushing of the liquids are accomplished through the deformed diaphragm 210. And, the larger the third included angle is, the stronger the liquid pumping ability of the valve core assembly 200 is, and for the booster pump 300, the pumping flow rate is larger, while correspondingly, the acting force on the diaphragm 210 is larger, and, in one reciprocating movement cycle of the support mechanism 100, when the support mechanism 100 is at an end point on the moving path, the acting force on the diaphragm 210 is maximum.

In related technologies, in the process that the valve core in the booster pump achieves the liquid pumping through the eccentric rotation, the diaphragm will be pushed and pulled repeatedly, and in the process of repeated pushing and pulling, a relatively large force will be acted on the deformed diaphragm, if the acting force goes beyond a threshold, the aging rate of the diaphragm will be expedited, or the diaphragm will be torn directly. If the diaphragm fails, the booster pump will lose the liquid pumping capacity, and thus the reliability of the booster pump is reduced, and then the service life of the booster pump 300 is affected.

In view of this, the cooperation position relationship between the eccentric wheel 230 and the diaphragm 210 is defined in the present disclosure. In an embodiment, the intersection point of the first axis and the axis of the shaft body 232 is the first intersection point. Since both the support mechanism 100 and the diaphragm 210 provided at the support mechanism 100 rotate eccentrically by taking the first axis as the axis, the relative position of the first intersection point and the support mechanism 100 and the diaphragm 210 will not move with respect to the diaphragm 210 and the support mechanism 100 in the eccentrical rotation process. On the above basis, the first intersection point is located on the two end surfaces of the diaphragm 210, or located between the two end surfaces of the diaphragm 210. In an actual operation process, if the eccentric wheel 230 with a relatively large eccentric angle is adopted to drive the support mechanism 100, the pumping capacity of the valve core assembly 200 can be increased, but the force acted on the diaphragm 210 will further be increased correspondingly; the present disclosure defines the position relationship between the first intersection point and the diaphragm 210, and this can match the eccentric angle of the eccentric wheel 230 with the thickness of the diaphragm 210, and ensure that the assembled diaphragm 210 can bear the repeated pushing and pulling of the support mechanism 100 driven by the current eccentric wheel 230, and prevent the diaphragm 210 from bearing an acting force beyond its own bearing capacity. Thus, the service life of the diaphragm 210 is prolonged, and the possibility that the diaphragm 210 is torn by the support mechanism 100 is reduced, to solve the above problems. Furthermore, the effects are achieved that the structure of the valve core assembly 200 is optimized, the reliability of the valve core assembly 200 is improved, and the service life of the valve core assembly 200 is prolonged.

As shown in FIG. 21, FIG. 22 and FIG. 17, in at least one embodiment of the present disclosure, the surface on the support mechanism 100 which contacts the diaphragm 210 is the contact surface 116; the contact surface 116 is a plane, and in the radial direction of the shaft body 232 from outside to inside, the contact surface 116 inclines towards a direction away from the diaphragm 210.

In the embodiment, the diaphragm 210 is positioned on the front end of the support mechanism 100, and the surface on the support mechanism 100 which contacts the diaphragm 210 is the contact surface 116. And, in the radial direction of the shaft body 232 from outside to inside, the contact surface 116 inclines towards a direction away from the diaphragm 210. The radial direction is the radial direction of the shaft body 232 and the annular support mechanism 100, the direction from outside to inside indicates the direction extending from the outer peripheral side of the support mechanism 100 to the axis of the support mechanism 100, to form the contact surface 116 which is higher at the outer side and is lower at the inner side in the radial direction from outside to inside. Disposing the above inclined contact surface 116 helps increase the area of the contact surface 116, and thus relieve the stress concentration effect on the diaphragm 210, to further slow down the aging rate of the diaphragm 210 and lower the probability of damaging the diaphragm 210.

In addition, in the process that the valve core in the booster pump 300 achieves the liquid pumping through eccentric rotation, the valve core which rotates eccentrically will generates vibration due to the radial load. The vibration trend will produce noises that affect users' experience. And, the larger the pumping flow rate of the booster pump 300 is and the larger the pumping pressure is, the larger the above radial load is, and the booster pump 300 with a high power and a high flow rate will generate a relatively obvious vibration in the operation process, and an excessive vibration will decrease the service life of the valve core and the booster pump 300; moreover, if the vibration trend is transmitted to the application product of the booster pump 300, a relatively high noise will be produced and damage users' experience.

In view of this, through disposing the contact surface 116 with a higher outside and a lower inside, the contact surface 116 can compensate in a certain degree the eccentric angle, i.e., the third included angle, of the support mechanism 100 which rotates eccentrically, and thus, through reducing the radial load on the support mechanism 100 in the reciprocating movement, the vibration that the valve core assembly 200 generates in the operation process is reduced, to solve the problems of a relatively high vibration noise and the poor reliability. Furthermore, the effects are achieved that the structure of the valve core assembly 200 is optimized, the operating stability and the structural reliability of the valve core assembly 200 are improved, the operation noises of the product is lowered, the service life of the product is prolonged and the users' experience is improved.

In any of the above embodiments, the plane which is perpendicular to the axis of the shaft body 232 is a reference surface; and a fourth included angle is formed between the reference surface and the contact surface 116. As shown in FIG. 22, $\beta$ 2 shows the fourth included angle; the degree of the third included angle is the first angle, and the degree of the fourth included angle is the second angle; and, the second angle is the product of N and the first angle, and $0.5 \leq N \leq 1.5$.

In the embodiment, the contact surface 116 is further described. A plane which is perpendicular to the axis of the support mechanism 100 is taken as the reference surface, the included angle between the reference surface and the contact surface 116 is the fourth included angle, and the fourth included angle is a structural compensation angle of the third included angle. Through adjusting the second angle, firstly, the deformation amplitude of the diaphragm 210 can be adjusted, and thus the magnitude of the stress inside the diaphragm 210 is adjusted. Secondly, through adjusting the second angle, the radial load on the support mechanism 100 in the reciprocating movement process can be adjusted.

On the above basis, the relationship between the third included angle and the fourth included angle is defined. In an embodiment, the degree of the third included angle is the first angle, and the degree of the fourth included angle is the second angle. The fourth included angle=N×the third included angle. And, the numeric range of N is greater than or equal to 0.5, and less than or equal to 1.5. Through limiting that the second angle is greater than or equal to 0.5 time of the third included angle, the effectiveness of the radial stress compensation can be ensured, and it is prevented that the compensation effect is lost as the fourth included angle is too small. Correspondingly, through limiting that the second angle is less than or equal to 1.5 times of the third included angle, it can prevent the inclinedly arranged contact surface 116 from excessively compensating the radial load, and prevent the appearance of the radial load on the support mechanism 100 which has a direction opposite to the direction of the original radial load. Meanwhile, through limiting the magnitude relationship between the first angle and the second angle, the component force of the support mechanism 100 in the radial direction can be reduced at the end point, i.e., at the maximum pressure point, of the stroke of the reciprocating movement of the support mechanism 100, to inhibit the vibration trend of the support mechanism 100. Furthermore, the effects are achieved that the structure of the support mechanism 100 is optimized, the rotation stability of the support mechanism 100 is improved, the noises generated during the vibration of the product is lowered, and the service life of the valve core assembly 200 is prolonged.

In any of the above embodiments, the support mechanism 100 comprises: a base 110, and the base 110 presents an annular shape, and the axis of the base 110 coincides with the axis of the shaft body 232; at least three positioning members 112, arranged at the base 110, and the diaphragm 210 is connected to the end surface of the positioning member 112.

In the embodiment, the structure of the support mechanism 100 is described in detail. The support mechanism 100 comprises the base 110 and the positioning member 112. The base 110 is the main frame structure of the support mechanism 100, and configured to position and support the positioning member 112 provided at the base 110. The positioning member 112 is provided at the base 110, and a first positioning surface is located on the end surface of the positioning member 112. When the diaphragm 210 is assembled, the diaphragm 210 is placed on the positioning member 112, and then the assembling is accomplished when the diaphragm 210 is connected to the positioning member 112, and the surface on the positioning member 112 which contacts the diaphragm 210 is the contact surface 116; when the contact surface 116 is a plane, the contact surface 116 on each positioning member 112 inclines towards the direction of the base 110, to form an array of the contact surfaces 116 with a higher outside and a lower inside.

And, there are at least three positioning members 112, to ensure the stability of the positioning member 112 in supporting the diaphragm 210, and lower the possibility that the diaphragm 210 inclines on the valve core assembly 200. Through configuring the structure of the positioning members 112 on the support mechanism 100, it can provide convenience for pushing and pulling the diaphragm 210 in the operation process, and can increase the deformation amplitude of the diaphragm 210 and reduce the acting forces required for pushing and pulling the diaphragm 210. Furthermore, the effects are achieved that the structure of the support mechanism 100 is optimized, the pumping flow rate and the pumping pressure of the booster pump 300 which uses the valve core assembly 200 are promoted, and the competitiveness of associated products is improved.

As shown in FIG. 20, FIG. 21 and FIG. 22, in at least one embodiment of the present disclosure, the contact surfaces 116 of at least three positioning members 112 intersect at a second intersection point. As shown in FIG. 20 and FIG. 22, D shows the second intersection point, and the second intersection point is located on the axis of the base 110.

In the embodiment, based on the above embodiments, the contact surfaces 116 are planes, and the contact surfaces 116 on each positioning member 112 incline towards the direction of the base 110. On this basis, through defining that the contact surfaces 116 of the at least three positioning members 112 intersect at the second intersection point, and defining that the second intersection point is located on the axis of the base 110, an array of multiple contact surfaces 116 arranged by the same method can be formed on the positioning members 112. Thus, the direction of the mutual acting force between the diaphragm 210 and the support mechanism 100 is optimized, and this helps reduce the join force of the support mechanism 100 in the radial direction which is perpendicular to the first axis, and thus firstly reduces the stress inside the diaphragm 210 and secondly promotes the compensation effect of the inclined contact surface 116 to the eccentrical rotation of the support mechanism 100, and lowers the radial load on the support mechanism 100. Furthermore, the effects are achieved that the structure of the support mechanism 100 is optimized, the stability of the rotation of the support mechanism 100 is improved, the noise caused by the vibration of products is lowered, the service life of the diaphragm 210 is prolonged and the users' experience is improved.

In any of the above embodiments, the distance between the first intersection point and the second intersection point in the direction of the first axis is a first distance value; the length of the diaphragm 210 in the direction of the first axis is a second distance value; and the first distance value is less than or equal to the second distance value.

In the embodiment, based on the above embodiments, the position relationship between the first intersection point and the second intersection point is defined. The second intersection point is located on the axis of the support mechanism 100 and the shaft body 232, and the first intersection point is located on the first axis. The first intersection point can coincide with the second intersection point, or there is a space between them in the axial direction of the support mechanism 100. On this basis, in the direction of the first axis, the distance value between the first intersection point and the second intersection point is the first distance value; when the first intersection point coincides with the second intersection point, the first distance value is 0. When the first intersection point is spaced from the second intersection point, the first distance value can be calculated by the space between them and the third included angle, which will not be described herein. Meanwhile, in the direction of the first axis, the length of the diaphragm 210 is the second distance value. And the larger the first distance value is, the stronger the stress concentration effect on the diaphragm 210 is; through defining that the first distance value is less than or equal to the second distance value, the force acted on the diaphragm 210 can be associated with the length of the diaphragm 210 in the direction of the first axis, and then the matching degree between the diaphragm 210 and the eccentric wheel 230 is further improved. The eccentric angle of the eccentric wheel 230 is matched with the thickness of the diaphragm 210, and it is ensured that the mounted diaphragm 210 can bear the repeated pushing and pulling of the support mechanism 100 driven by the current eccentric wheel 230, and the diaphragm 210 is prevent from bearing a force beyond its own bearing capacity. Thus, the service life of the diaphragm 210 is prolonged, and the possibility that the diaphragm 210 is torn by the support mechanism 100 is lowered, to solve the above problems. Furthermore, the effects are achieved that the structure of the valve core assembly 200 is optimized, the reliability of the valve core assembly 200 is improved, and the service life of the vale core assembly 200 is prolonged.

As shown in FIG. 19, FIG. 21 and FIG. 22, in at least one embodiment of the present disclosure, the eccentric wheel 232 further comprises: a shaft hole 234, provided in the eccentric wheel 230, and the axis of the shaft hole 234 coincides with the first axis.

In the embodiment, the eccentric wheel 230 comprises a cylindrical shaft body 232 and the shaft hole 234 provided in the shaft body 232, and the axis of the shaft body 232 is the axis of the eccentric wheel 230. The support mechanism 100 is sleeved on the eccentric wheel 230, and the axis of the support mechanism 100 coincides with the axis of the eccentric wheel 230. In the operation process, the eccentric wheel 230 rotates by taking the axis of the shaft hole 234 as the axis; under a shape matching relationship, the eccentric wheel 230 drives the support mechanism 100 to rotate about the axis, i.e., the first axis, of the shaft hole 234 at the same time, to help push and pull the diaphragm 210 through the eccentrical rotation of the support mechanism 100.

Through disposing the eccentric wheel 230, the eccentrical rotation of the support mechanism 100 can be formed through the contact cooperation between the embedded structures, and the cooperation structure has a relatively high compactness and a relatively strong reliability, helps reduce rotation errors caused by the gaps of the structures, and helps reduce the noises caused by the vibration of the valve core assembly 200. In addition, the structure occupies a relatively small space, and can reduce the difficulty in arranging the valve core assembly 200 inside the booster pump 300, and helps achieve the lightweight design and miniaturization design of the booster pump 300. Meanwhile, the difficulty in disassembling and assembling the structure is relatively low; when the support mechanism 100 or the eccentric wheel 230 fails, users can conveniently accomplish the maintenance and replacement of the structure through disassembling and assembling. Furthermore, the effects are achieved that the compactness of the structure of the valve core assembly 200 is improved, the size of the valve core assembly 200 is reduced, and the stability and the reliability of the valve core assembly 200 during the operation are improved.

In any of the above embodiments, the valve core assembly 200 further comprises: a bearing 254, sleeved on the eccentric wheel 230, and the support mechanism 100 is sleeved on the bearing 254.

In the embodiment, the valve core assembly 200 is further provided with the bearing 254. The bearing 254 is sleeved on the shaft body 232 of the eccentric wheel 230, the support mechanism 100 is sleeved on the bearing 254, and then the eccentric wheel 230, the bearing 254 and the support mechanism 100 which are embedded sequentially from inside to outside are formed. Through disposing the bearing 254 between the support mechanism 100 and the eccentric wheel 230, the rotating connection between the support mechanism 100 and the eccentric wheel 230 can be achieved. Thus, the relative rotating trend between the support mechanism 100 and the diaphragm 210 is eliminated on the basis of maintaining the radial movement of the support mechanism 100.

Disposing the bearing 254 helps reduce the frictional force between the eccentric wheel 230 and the support mechanism 100, and reduce the torque that the support mechanism 100 applies to the diaphragm 210, and prevent the diaphragm 210 from being twisted and torn by the support mechanism 100. Meanwhile, disposing the bearing 254 can further improve the stability and reliability of the transmission between the eccentric wheel 230 and the support mechanism 100, and can inhibit in a certain degree the vibration of the valve core assembly 200 and reduce the noise of the support mechanism 100 during the operation. Furthermore, the effects are achieved that the structure of the valve core assembly 200 is optimized, the stability of the valve core assembly 200 during the operation is improved and the fault rate of the valve core assembly 200 is reduced.

In any of the above embodiments, the valve core assembly 200 further comprises: a first convex rib 118, provided at the support mechanism 100; a second convex rib 236, provided at the eccentric wheel 230, and the two end surfaces of the bearing 254 respectively abut the first convex rib 118 and the second convex rib 236.

In the embodiment, based on the above embodiments, the positioning structure of the bearing 254 is defined. The first convex rib 118 is provided at the inner annular surface of the support mechanism 100, and the second convex rib 236 is provided at the peripheral side surface of the shaft body 232. After assembled, one of the end surfaces of the bearing 254 leans against the first convex rib 118, the other opposite end surface leans against the second convex rib 236, to limit the bearing 254 between the support mechanism 100 and the eccentric wheel 230.

In the assembling process, firstly, the bearing 254 is sleeved on the shaft body 232, until the lower end surface of the shaft body 232 leans against the second convex rib 236; then the support mechanism 100 is sleeved on the outer side of the bearing 254, until the first convex rib 118 leans against the upper end surface of the bearing 254. Through disposing the first convex rib 118 and the second convex rib 236, the bearing 254 is prevented from jumping between the support mechanism 100 and the eccentric wheel 230, to lower the vibration and noise generated by the valve core assembly 200 in the operation process. Furthermore, the effects are achieved that the transmission structure of the support mechanism 100 is optimized, the stability and reliability of the eccentric rotation of the support mechanism 100 is improved, and the noise caused by the vibration of products is reduced.

In any of the above embodiments, the valve core assembly 200 further comprises: a drive shaft 252, passing through a shaft hole 234; and a drive member 256, connected to the drive shaft 252.

In the embodiment, the valve core assembly 200 is further provided with the drive shaft 252 and the drive member 256. The drive member 256 can be a motor, and the power output shaft of the drive member 256 is connected to one end of the drive shaft 252 through a coupling, to drive the drive shaft 252 to rotate. The other end of the drive shaft 252 passes through the shaft hole 234 of the eccentric wheel 230, and is connected to the eccentric wheel 230.

In an embodiment, the drive shaft 252 can be connected to the eccentric wheel 230 through a positioning key and a key groove, or the axial connection between the drive shaft 252 and the eccentric wheel 230 can be accomplished through the arrangement that the shapes of the cross-sections of the shaft hole 234 and the drive shaft 252 are polygons, while the connecting method is not limited herein, as long as the drive shaft 252 can drive the eccentric wheel 230 to rotate synchronously. In the operation process, the power output from the drive member 256 is transferred to the support mechanism 100 through the drive shaft 252, the eccentric wheel 230 and the bearing 254, and the support mechanism 100 rotates eccentrically about the axis of the drive shaft 252, and the support mechanism 100 that rotates eccentrically pushes and pulls the diaphragm 210 to accomplish the liquid pumping.

In any of the above embodiments, the valve core assembly 200 further comprises: a compression member 220, provided at the side of the diaphragm 210 away from the positioning member 112, abutting the diaphragm 210, and configured to compress the diaphragm 210 on the positioning member 112.

In the embodiment, the valve core assembly 200 is further provided with the compression member 220, and the compression member 220 is provided at the diaphragm 210. After assembled, the compression member 220 leans against the diaphragm 210, and the diaphragm 210 is compressed between the support mechanism 100 and the compression member 220, to achieve the assembling and clamping of the diaphragm 210. And, the diaphragm 210 is the main operating portion of the booster pump 300, and in the operation process, the booster pump 300 drives the diaphragm 210 to move and the size of the space partitioned by the diaphragm 210 changes, to accomplish the drawing, pressure boosting and discharging of mediums.

Through disposing the support mechanism 100 and the compression member 220, the diaphragm 210 can be positioned accurately in the booster pump 300, to lower the possibility of the dislocation of the diaphragm 210 in the operation process. In addition, the compression member 220 can compress the diaphragm 210 on the support mechanism 100, to eliminate the gap between the first positioning surface and the diaphragm 210.

In any of the above embodiments, the number of the compression members 220 is equal to the number of the positioning members 112, and the compression members 220 and the positioning member 112 are arranged in a one-to-one correspondence manner.

In the embodiment, the structure of the compression members 220 is described in detail. Each valve core assembly 200 is provided with multiple compression members 220, and the number of the compression members 220 is equal to the number of the positioning members 112 on the base 110. In the assembling process, firstly, the diaphragm 210 is aligned with and placed on at least three positioning members 112. Then, one compression member 220 is provided correspondingly for each positioning member 112 at the side of the diaphragm 210 away from the support mechanism 100, and the compression member 220 is compressed on the diaphragm 210, and the diaphragm 210 is compressed on the positioning portion 112 by the compression member 220.

Through defining the above structure, firstly, the stability for positioning the diaphragm 210 by the valve core assembly 200 can be improved by disposing multiple compression members 220, and the possibility that the diaphragm 210 is dislocated between the support mechanism 100 and the compression member 220 is reduced. Secondly, the structure can provide convenience for the valve core assembly 200 in pushing and pulling the diaphragm 210 in the operation process, and can increase the deformation amplitude of the diaphragm 210 and reduce the acting forces required for pushing and pulling the diaphragm 210. Furthermore, the effects are achieved that the structure of the valve core assembly 200 is optimized, the pumping flow rate and the pumping pressure of the booster pump 300 which uses the valve core assembly 200 are promoted, and the competitiveness of associated products is improved.

As shown in FIG. 18, at least one embodiment of the present disclosure provides a booster pump 300, and the booster pump 300 comprises: a housing 310 having a cavity; the valve core assembly 200 in any of the above embodiments, provided in the cavity, and the diaphragm 210 is connected to the housing 310, and the cavity is partitioned by the diaphragm 210.

In the embodiment, the booster pump 300 provided with the valve core assembly 200 in any of the above embodiments is defined, and thus the booster pump 300 has the advantages of the valve core assembly 200 in any of the above embodiments, and can achieve the effect that the valve core assembly 200 in any of the above embodiments achieves, which are not described herein for avoiding repetition. The booster pump 300 comprises the housing 310, and the housing 310 is an external frame structure of the booster pump 300, and configured to enclose and define the cavity. The support mechanism 100 and the compression member 220 are disposed in the cavity, and position the diaphragm 210 in the housing 310.

And, the peripheral side of the diaphragm 210 is connected to the inner wall of the housing 310, to partition the cavity into two sub-cavities; the support mechanism 100 and the compression member 220 are respectively located in the sub-cavities at the two sides of the diaphragm 210. When the support mechanism 100 drives a portion of the diaphragm 210 and the compression member 220 to move with respect to the housing 310, the diaphragm 210 connected to the housing 310 is pushed and pulled, and thus deformed. In a pulling process, the volume of the sub-cavity where the compression member 220 is located increases, and the booster pump 300 can absorb mediums into the sub-cavity. When the diaphragm 210 is pushed by the support mechanism 100 towards the direction of the compression member 220, the volume of the sub-cavity where the compression member 220 is located decreases, and the mediums in the sub-cavity is pushed out of the booster pump 300. Furthermore, the booster pump 300 achieves medium pumping.

In any of the above embodiments, the housing 310 further comprises an inlet and an outlet, and the inlet and the outlet communicate with the cavity at the side of the diaphragm 210 away from the support mechanism 100.

In the embodiment, the housing 310 is provided with the inlet and the outlet for the entering and exiting of the mediums. Both the inlet and the outlet communicate with the sub-cavity at one side of the diaphragm 210. The support mechanism 100 and the drive member 256 are provided in the sub-cavity at the side away from the inlet and the outlet. The drive member 256 is fixed on the housing 310, and the support mechanism 100 connects the drive member 256 and the diaphragm 210. When the booster pump 300 operates, the drive member 256 drives the support mechanism 100 and the compression member 220 to move with respect to the housing 310, to achieve the absorbing and discharging of the mediums through pushing and pulling the diaphragm 210.

At least one embodiment of the present disclosure provides a water purifier, and the water purifier comprises the booster pump 300 in any of the above embodiments.

In the embodiment, the water purifier provided with the booster pump 300 in any of the above embodiments is defined, and thus the water purifier has the advantages of the booster pump 300 in any of the above embodiments, and can achieve the effect that the booster pump 300 in any of the above embodiments achieves, which are not described herein for avoiding repetition.

In the specification of the present disclosure, the term of "multiple" indicates two or more, unless otherwise explicitly specified or defined; the orientation or position relations indicated by the terms of "upper," "lower" and the like are based on the orientation or position relations shown in the accompanying drawings, and they are just intended to conveniently describe the present disclosure and simplify the description, and are not intended to indicate or imply that the devices or units as indicated should have specific orientations or should be configured or operated in specific orientations, and then should not be construed as limitations to the present disclosure; the terms of "connected to," "assembling," "fixing" and the like should be understood in a broad sense, for example, the term "connected to" may be a fixed connection, and may further be a removable connection, or an integral connection; and the term may be a direct connection and may further be an indirect connection through an intermediate medium. A person of ordinary skills in the art could understand the specific meanings of the terms in the present disclosure according to specific situations.

In the description of the present specification, the descriptions of the phrases "one embodiment," "some embodiments" and "specific embodiments" and the like mean that the specific features, structures, materials or characteristics described in combination with the embodiment(s) or example(s) are included in at least one embodiment or example of the present disclosure. In the specification, the schematic representation of the above phrases does not necessarily refer to the same embodiment or example. Moreover, the particular features, structures, materials or characteristics described may be combined in a suitable manner in any one or more of the embodiments or examples.

The descriptions above are only some embodiments of the present disclosure, and are not configured to limit the present disclosure. For a person skilled in the art, the present disclosure may have various changes and variations. Any modifications, equivalent substitutions, improvements, etc. made within the spirit and principle of the present disclosure shall all be included in the protection scope of the present disclosure.

What is claimed is:

1. A support mechanism comprising:

a base including a guide groove and a blind hole;

a guide member provided in the blind hole and including a guide slope opposite to a side wall of the blind hole, the guide member being enclosed by the guide slope and the blind hole; and a heat-blocking member provided at the base and partially embedded in the guide groove, the heat-blocking member being configured to support a diaphragm and drive the diaphragm to move;

wherein:

a cross-sectional area of the guide groove gradually decreases along a depth direction of the guide groove;

a shape of a cross-section of the guide groove is a first regular polygon;

a shape of a cross-section of the guide member is a second regular polygon;

a number of sides of the first regular polygon is same as a number of sides of the second regular polygon; and a peripheral side surface of the guide member abuts a side wall of the guide groove.

2. The support mechanism according to claim 1, wherein the shape of the cross-section of the guide member is a hexagon.

3. The support mechanism according to claim 1, wherein the guide groove is one of N guide grooves uniformly arranged at the base, N being an integer greater than 2.

4. The support mechanism according to claim 3, wherein the base has an annular shape, and the N guide grooves are uniformly arranged in a circle with an axis of the base as a center of the circle.

5. The support mechanism according to claim 3, wherein the heat-blocking member is one of N heat-blocking members connected to the N guide grooves in a one-to-one correspondence manner.

6. The support mechanism according to claim 1, wherein the heat-blocking member includes:

a base body; and a protrusion member provided at the base body and embedded in the guide groove.

7. The support mechanism according to claim 6, wherein the protrusion member is in interference fit with the guide groove.

8. The support mechanism according to claim 1, wherein the heat-blocking member is detachably connected to the base.

9. The support mechanism according to claim 1, further comprising:

a connection member configured to connect the base and the heat-blocking member.

10. A valve core assembly comprising:

the support mechanism according to claim 1; and a diaphragm provided at the heat-blocking member;

wherein the heat-blocking member is located between the base and the diaphragm.

11. The valve core assembly according to claim 10, further comprising:

a compression member provided at the diaphragm and away from the heat-blocking member, the compression member being connected to the heat-blocking member and configured to compress the diaphragm on the heat-blocking member.

12. A booster pump comprising:

a housing having a cavity; and the valve core assembly according to claim 10 provided in the cavity;

wherein the diaphragm is connected to the housing, and the cavity is partitioned by the diaphragm.

13. The booster pump according to claim 12, wherein the housing further includes an inlet and an outlet, and the inlet and the outlet communicate with the cavity at a side of the diaphragm away from the base;

the booster pump further comprising:

a drive assembly connected to the base and configured to drive the base to swing with respect to the housing.

14. The booster pump according to claim 13, wherein the drive assembly includes:

a drive member including a drive shaft;

an eccentric wheel sleeved on the drive shaft; and a bearing, an inner ring of the bearing being sleeved on the eccentric wheel, and an outer ring of the bearing passing through the base.

15. A water purifier comprising:

the booster pump according to claim 12.

16. A support mechanism comprising:

a base including a positioning member provided with a guide groove; and a heat-blocking member provided at the base and partially embedded in the guide groove, the heat-blocking member being configured to support a diaphragm and drive the diaphragm to move, the heat-blocking member including a base body, a mounting groove, and a protrusion member provided in the mounting groove and embedded in the guide groove, wherein:

a cross-sectional area of the guide groove gradually decreases along a depth direction of the guide groove;

a shape of the mounting groove matches an outer contour of the positioning member, and a shape of the protrusion member matches a shape of the guide groove.

* * * * *